US005149157A

United States Patent [19]

Laugery et al.

[11] Patent Number: 5,149,157

[45] Date of Patent: Sep. 22, 1992

[54] DEVICE FOR LOCKING AN EMERGENCY EXIT

[75] Inventors: Charles M. Laugery, La Trinite; Paul A. Mombelli, Nice, both of France

[73] Assignee: Mecanismes Electroniques Realises Innovation Conception Brevets, Sartrouville, France

[21] Appl. No.: 708,926

[22] Filed: May 31, 1991

[30] Foreign Application Priority Data

Jun. 5, 1990 [FR] France ..... 90 06951

[51] Int. Cl.[5] ..... E05B 15/02

[52] U.S. Cl. ..... 292/341.16; 292/DIG. 49

[58] Field of Search ..... 292/341.16, 341.17, 292/201, DIG. 49

[56] References Cited

U.S. PATENT DOCUMENTS 3,207,273 9/1965 Jurin ..... 292/341.16 X
4,626,010 12/1986 Hanchett, Jr. et al. ..... 292/341.16
4,756,566 7/1988 Logas ..... 292/341.16

*Primary Examiner*—Richard E. Moore

*Attorney, Agent, or Firm*—Hoffman, Wasson & Gitler

[57] ABSTRACT

The locking device is capable selectively of taking up a first operating mode for use in the presence of the public in which it provides positive safety unlocking under remote control by interrupting the current feeding an electromagnet, and a second operating mode for use when the public is absent, and which is more secure. The device includes a bolt pivotally mounted about a bolt axis. The pivoting bolt co-operates with a retraction spring which has energy stored therein when the bolt is in its door-closing position, and also with a locking piston which is guided by a guide part to move perpendicularly to the axis. The bolt-locking means includes a toggle mechanism comprising a first link that pivots about a fixed first axis, and a second link hinged about a moving second axis to the first link and about a moving third axis to the piston. The moving second and third axes are parallel to the fixed first axis. In the locked position, the axes are substantially in alignment along the displacement direction of the piston and a toggle-collapsing spring has energy stored therein.

18 Claims, 22 Drawing Sheets

DEVICE FOR LOCKING AN EMERGENCY EXIT

The present invention relates in general terms to devices for locking emergency exits, and it relates more particularly to a locking device for an emergency exit including at least one door mounted relative to a fixed wall, the locking device being capable for locking purposes of selectively taking up a first mode of operation when the public is present and that provides positive safety, with unlocking being under remote control by an electrical current being interrupted, and a second mode of operation when the public is not present and that provides enhanced security, said locking device comprising a support plate for fixing to one of said fixed wall and said door constituting said emergency exit, a bolt for co-operating with at least one catch element defining a keeper and fixed to the other one of said door and said fixed wall constituting said emergency exit, locking means for locking said bolt, unlocking control means for unlocking said locking means, and enhanced security means for selectively inhibiting the operation of said unlocking control means.

BACKGROUND OF THE INVENTION

Traditionally, emergency exits from public or private premises that receive the public have been fitted with locking means constituted by chains and padlocks. Such locking means have been found to be completely unsuitable since, for example, in the event of a fire it is not possible to open the emergency exits quickly and effectively.

Locks for unlocking emergency exits have therefore been provided that are capable of operating under remote control by an electrical current being interrupted, i.e. locks in which a door can be released only under the effect of energy stored within the lock, e.g. by means of a spring.

However, to be effective, the system for unlocking an emergency exit must not only be suitable for remote control by interrupting a current, it must also be capable of responding to release of the energy stored in the lock even, if the door is being subjected to significant pressure at the time of release, e.g. by panic-stricken users. This is particularly difficult to ensure in simple manner.

It may also be observed that in practice, an emergency exit from premises that receive the public nearly always has two quite distinct modes of operation:

when the public is present, generally in daytime, the emergency exit must be governed by regulations for ensuring personal safety, even at the expense of reduced security for property, and even though security for property continues to be the major worry of the person responsible for the security of the premises; and when the public is absent, generally at night, the emergency exit returns to being an ordinary door, not subject to administrative constraints concerning personal safety, but with an obvious and increased function of protecting property.

Locks have already been proposed for closing emergency exits while satisfying safety regulations, which locks are such that a door is held in place by a device that retracts in the event of feed current being interrupted or whenever forces greater than some predetermined value (e.g. about 60 dN) are applied thereto. With respect to personal safety, such locks are satisfactory insofar as they are easily opened in an emergency, however they are not very effective at protecting property. It is therefore often necessary to add additional locking means thereto in order to reinforce the invulnerability of emergency exits to tampering, particularly when the public is absent.

Locks are also known having a lock-bolt driven by an electromagnet and implemented in such a manner that powering the electromagnet drives a metal part to interpose itself between the bolt and its keeper to prevent the door being opened. Simultaneously, this action compresses a return spring for returning the bolt into the body of the lock when the power supply to the electromagnet is interrupted. Users find that the strength of the bolt is quite satisfactory, however there is no chance of the spring unlocking the door if pressure is being exerted on the door at the moment the spring is required to act, thereby making the system incompatible with safety regulations that require an emergency exit to be capable of opening even when major pressure is being exerted on the door.

Safety devices are also known suitable for fitting to anti-panic bars. Such devices introduce a delay in the action of the anti-panic bar. When a user presses against a bar, the pressure does not act on means for unlocking the door, but rather starts a timeout of a few seconds' duration while simultaneously generating a remote alarm. If the user releases the bar, thinking that the door is locked, then the timeout starts again. However, if the user maintains pressure throughout the timeout, then at the end of the timeout the door unlocks. It may be observed that anti-panic bars, by the design of the locks on which they act, cannot be considered as constituting high security locking means. In addition, safety devices based on a timeout and on triggering a remote alarm suffer from the drawback of giving users thereof a great many false alarms coming from people, often with no evil intent, pressing against the bars either by mistake or by clumsiness.

Electromagnetic door-holders are also known which are not properly speaking locks at all. With this type of equipment, so long as power is delivered to an electromagnet fixed on the door frame, it holds a plate made of magnetic metal and fixed on the door. The attractive force of such devices is considerably less than the break-in resistance that can be expected of a good lock, so such devices cannot prevent a door being broken open by application of violent shocks. In addition, such equipment does not take account of the problem of providing locking when the public is not on the premises. From the above it can be seen that none of the prior art locks for use with emergency exits provides a satisfactory solution to all of the locking requirements both of their purchasers and of the authorities, since none of the prior locks solves the contradictions of the following requirements taken together:

unlocking in the event of a power failure and in the presence of the public, no unlocking when a power failure occurs while the public is not present;

very robust locking both day and night which nevertheless retracts reliably when required to even if several panic-stricken users are pressing frantically against the doors of an emergency exit; and remotely controllable and very reliable changeover between public-present and public-absent modes of operation.

The present invention seeks to remedy the above-mentioned drawbacks and to take account of all of the requirements mentioned above so as to provide an effective locking device offering a very high degree of security in the absence of the public while nevertheless being very easily unlocked in the presence of the public and under remote control merely by interrupting the electrical power supply to the device, with changeover between a public-present mode of operation and a public-absent mode of operation being easily performed, preferably under manual or automatic remote control.

SUMMARY OF THE INVENTION

These objects are achieved by a locking device for an emergency exit and of the type specified at the beginning of the description, wherein, according to the invention, the bolt has a first portion including abutment means for coming into abutment against said catch element to prevent relative movement between said door and said fixed wall, and a second portion essentially perpendicular to said first portion and mounted to pivot about a bolt axis parallel to said first and second portions, wherein the bolt co-operates both with a retraction spring which has energy stored therein in the bolt-closed position, and with a locking piston guided by a guide part along a direction perpendicular to said pivot axis to bear in a locking position against the rear face of said second portion, and wherein the locking means further includes a toggle mechanism comprising a first link pivoting about a first axis perpendicular to the displacement direction of said piston and to the bolt axis and having a position which is fixed relative to the support plate, and a second link hinged firstly to the first link and secondly to the locking piston about respective second and third moving axes parallel to said first axis, the first, second and third axes, when in the locking position, being substantially in alignment on the axis of the piston, and a toggle-collapsing spring having energy stored therein when in said locking position.

Advantageously, in the locking position, the hinged assembly of the first and second links and the locking piston bears at the end of its stroke against an eccentric pivoting abutment disposed so as to enable the links to move a little past the position in which the first, second, and third axes are in accurate alignment, thereby creating a small negative angle of a few degrees between the first and second links so as to confer a position of stable equilibrium to the first and second links and to the piston.

According to one particular feature of the present invention, the unlocking control means comprises an unlocking arm pivotally mounted about an axis parallel to said first, second, and third axes, said arm being provided firstly at its free end with a retention disk disposed in such a manner as to lie, in the locking position, on the active face of an electromagnet, and secondly at its hinge end with an unlocking spring and with an eccentric cam having a plane portion which, in the positive safety unlocking position, strikes the second link under the action of the unlocking spring whenever the electrical power feeding the electromagnet is interrupted.

Preferably, the unlocking arm further includes a weight disposed in the vicinity of the free end of the arm in order to increase the striking force thereof.

In a preferred embodiment, the locking device includes an electric motor driving at least one resetting cam co-operating with a resetting mechanism and with locking mechanism control means for placing the locking device respectively in the locked position and in the enhanced security position.

In which case, in a first embodiment, the resetting mechanism includes a resetting lever and a resetting pusher cooperating with a return spring and with the unlocking arm. The locking mechanism may include a locking lever and a locking pusher co-operating with a return spring and with the first link.

In another embodiment, the resetting mechanism includes a resetting lever and a resetting link hinged to the unlocking arm, whereas the locking mechanism may include a locking lever and a locking link hinged to the first link.

In which case, the locking device may include a thrust bearing which exerts a reaction on the locking piston to compensate for the lateral pressure caused by the action of the locking link on the first link.

In a particular embodiment, the electric motor includes a worm screw coupled to its outlet shaft, said screw engaging a drive gear whose axis of rotation is common with the axis of rotation of the resetting cam and with the axis of rotation of the locking mechanism control means which are constituted by a locking cam.

According to a particular feature of the invention, the locking device includes an end-of-stroke microswitch, and a secure-position microswitch co-operating with components synchronized with the movement of the resetting mechanism and of the locking mechanism, and also a resetting microswitch and a locking microswitch for signalling the position of the unlocking arm and the position of the piston.

In an important aspect of the present invention, on each locking cycle of the device, all of its parts are initially positioned in the secure position, and then if the command for taking up the secure position is not being applied, the parts continue to move and come finally to rest in the positive safety locking position in which the door is locked while being unlockable by remotely interrupting the feed current to the electromagnet.

Advantageously, the locking device is mounted on said fixed wall and the bolt is designed to co-operate simultaneously with two catch elements defining two keepers fixed on two different halves of the door of said emergency exit, so as to enable both doors of the emergency exit to be locked simultaneously.

Magnetic contacts actuated by permanent magnets placed in the keepers may also be provided to signal the closed position of the doors of the exit.

BRIEF DESCRIPTION OF THE DRAWINGS

Embodiments of the invention are described by way of example with reference to the accompanying drawings, in which.

DETAILED DESCRIPTION

The emergency exit lock of the present invention (which is preferably a lock under control from an electric motor) may advantageously be placed at the top of a door on the door frame so as to be capable of locking both halves of a swing door simultaneously with a single bolt. However this is not essential and the bolt may equally well be installed in any position as explained below, and it may be used for locking a door way having only one door.

A locking device constituting a first embodiment of the invention is initially described with reference to FIGS. 1 to 6.

Figure 1:
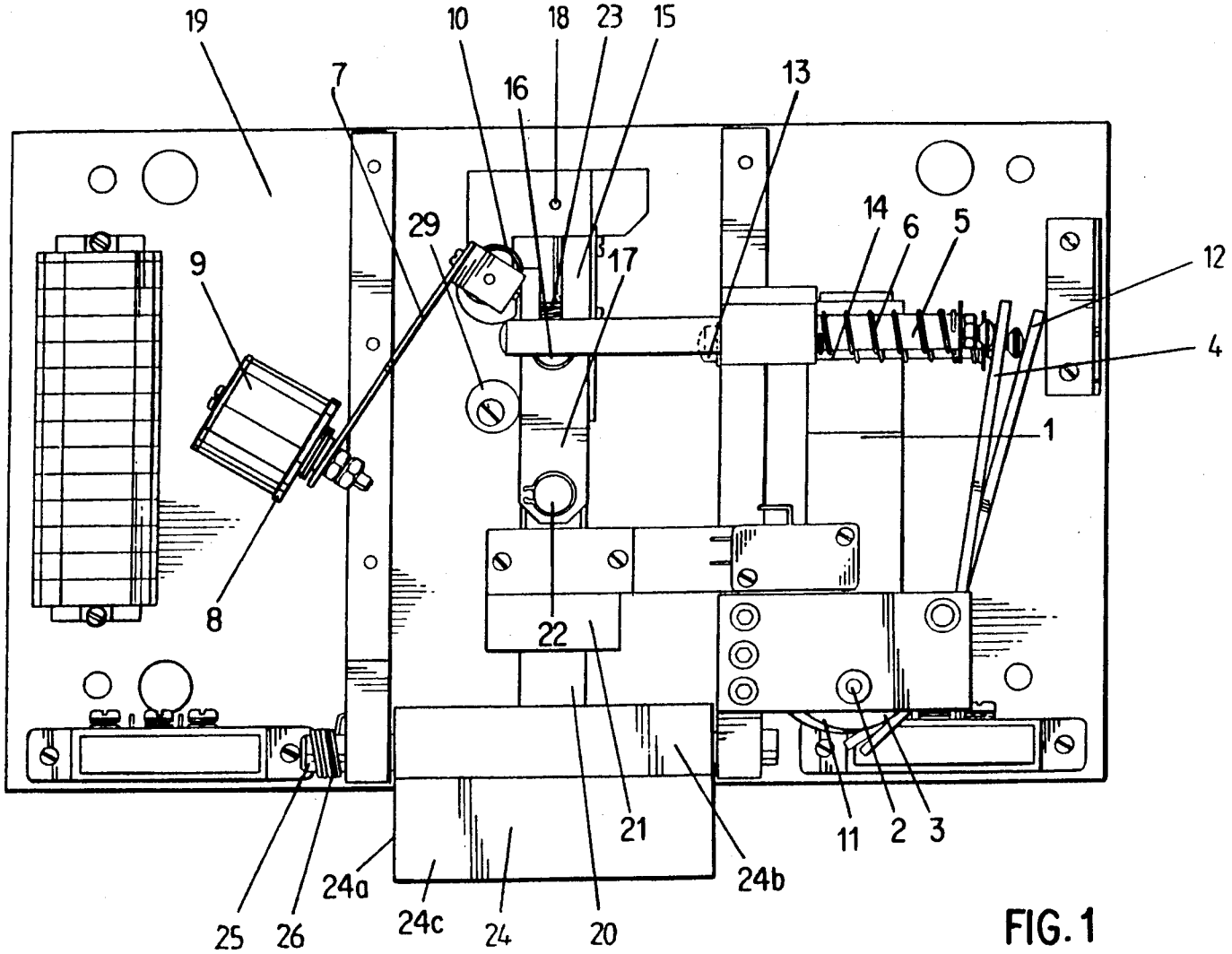
FIG. 1 is a front view showing the essential components of a locking device of the invention in a locked position, and constituting a first embodiment of the invention.
Figure 2:
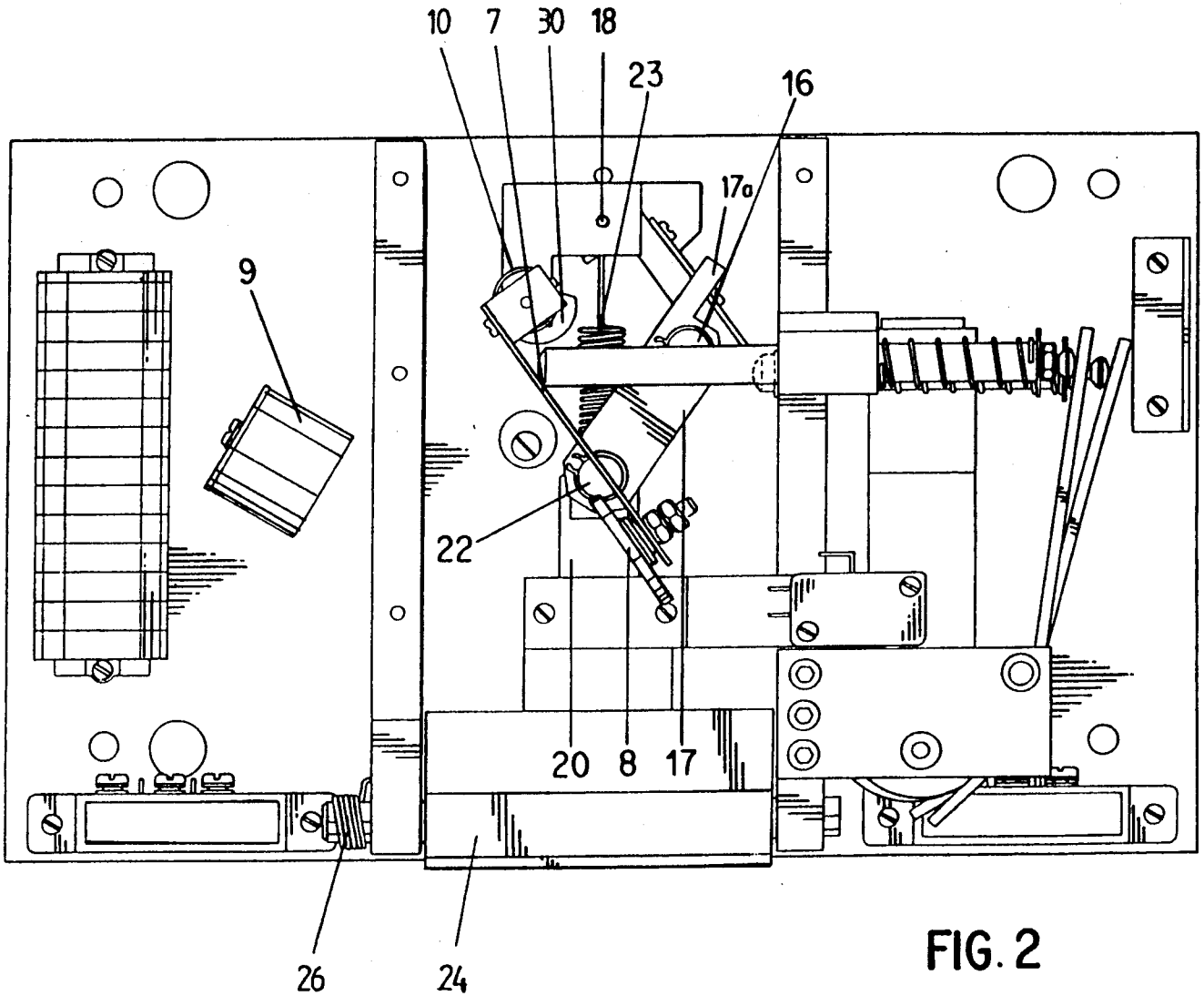
FIG. 2 is a view analogous to FIG. 1, showing the locking device in an unlocked position.
Figure 3:
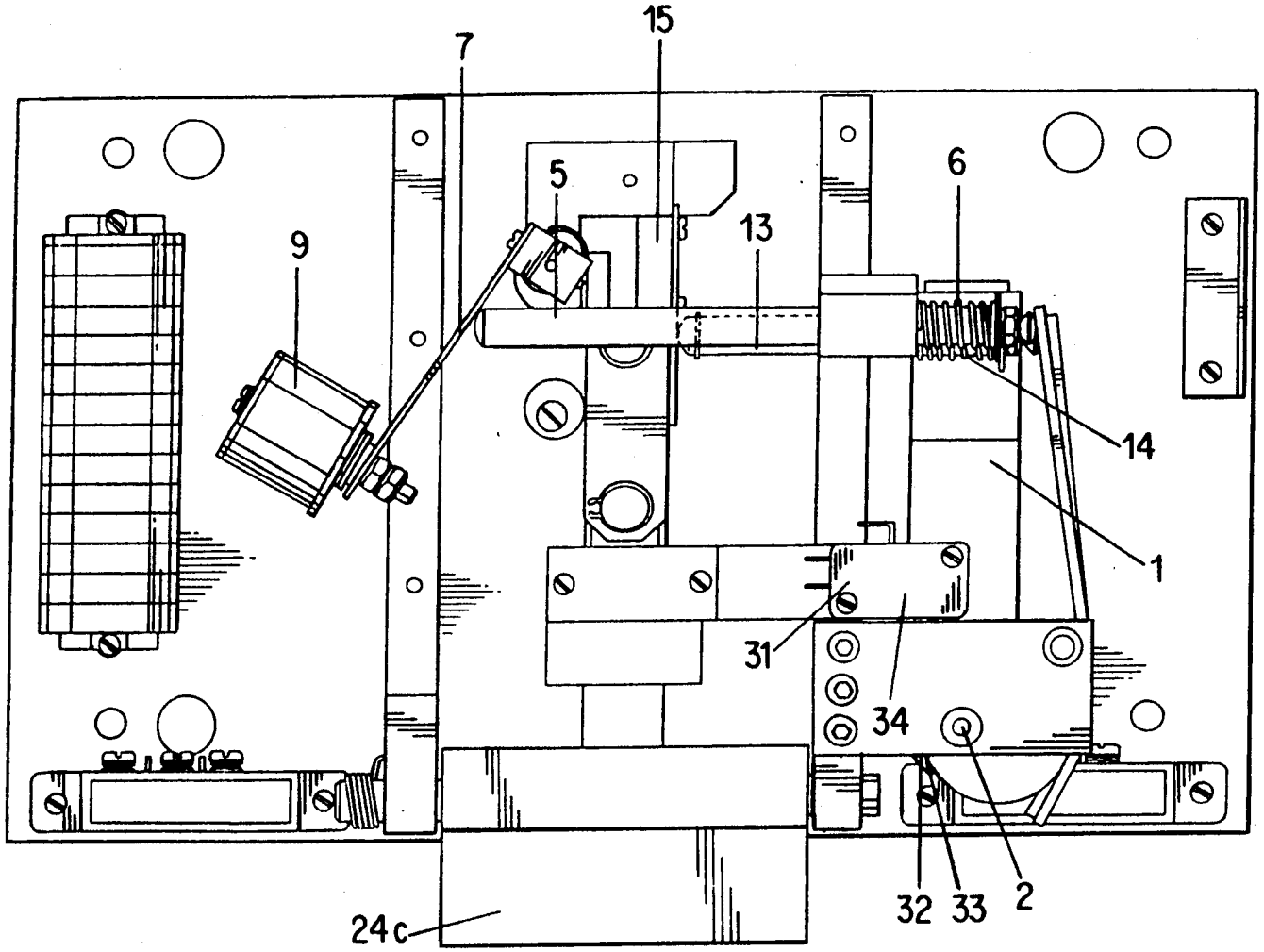
FIG. 3 is a view analogous to FIGS. 1 and 2 showing the locking device in a secure position.
Figure 5:
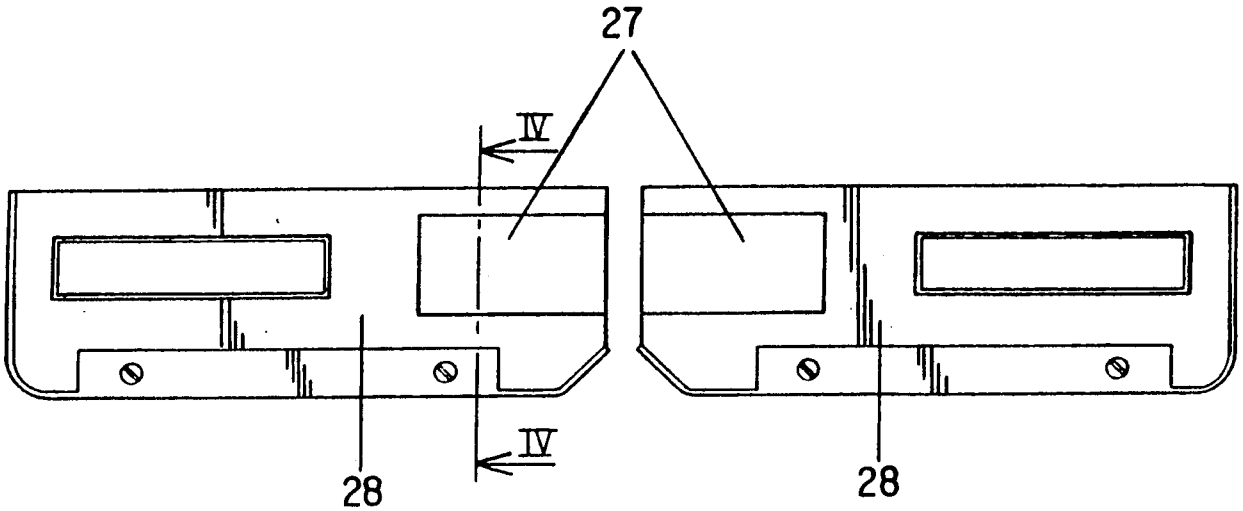
FIG. 5 is top end view showing a pair of keepers with which the bolt of the locking device of FIGS. 1 to 3 may co-operate.
Figure 4:
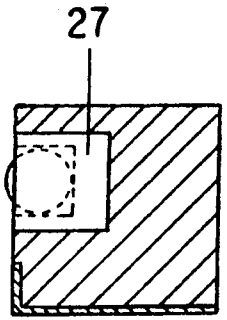
FIG. 4 is a section view on line IV—IV of FIG. 5 and shows a keeper with which the bolt of the locking device shown in FIGS. 1 to 3 may co-operate.

To facilitate the description, it is assumed that the plane of FIGS. 1 to 3 is vertical and that the bolt 24 of the locking device is at the bottom of the device, as is the case when the locking device is disposed above the door on the door frame.

Figure 6:
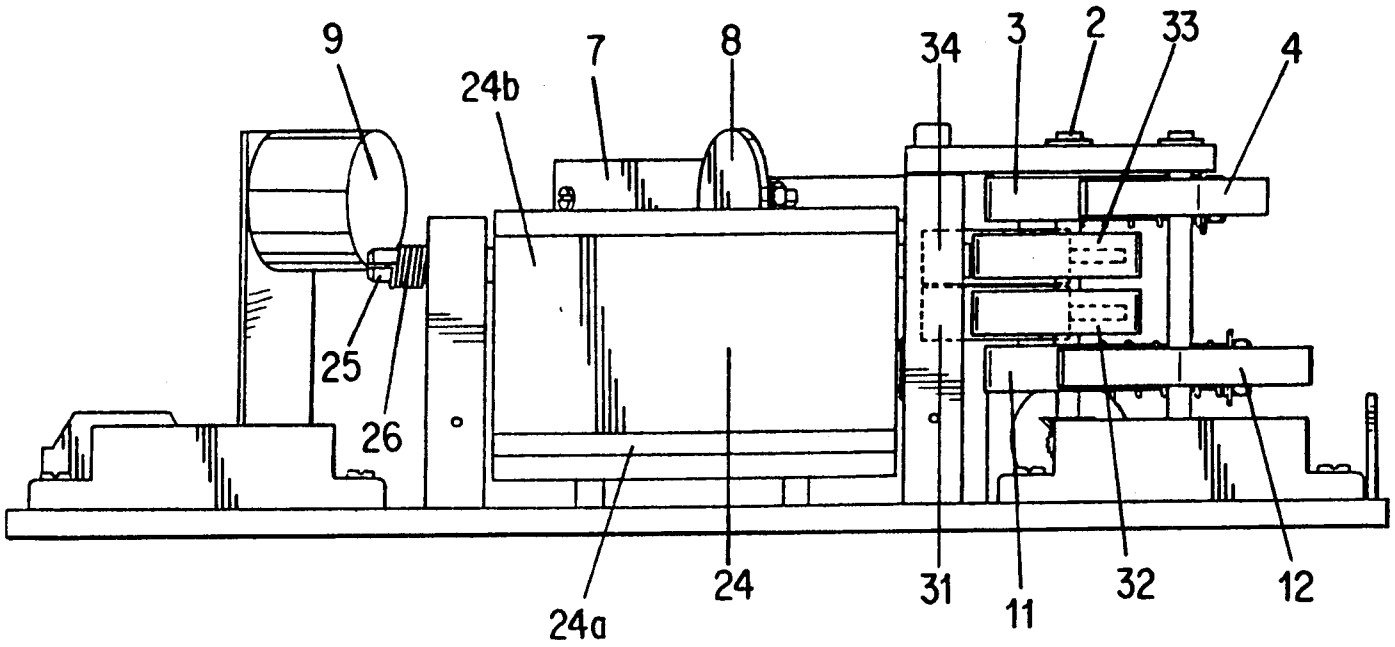
FIG. 6 is a bottom end view of the locking device of FIGS. 1 to 3.

The locking device comprises a support plate 19 fixed to the door frame of an emergency exit. A bolt 24 is hinged at the bottom of the plate 19 about a horizontal shaft 25. As can be seen in FIGS. 1 and 6, the bolt 24 is hook-shaped, or is in the shape of a walking-stick handle, comprising a first portion 24*a* for engaging in cavities 27 in keepers 28 fixed to the two halves of a swing door (FIG. 5), and a second portion 24*b* which is essentially perpendicular to the first portion 24*a* and has its end distant from the portion 24*a* pivotally mounted about a bolt shaft 25 extending parallel to the first and second portions 24*a* and 24*b* and disposed horizontally when applying the above-specified conventions. The first portion 24*a* of the bolt 24 has at least one plane face 24*c* which serves as a retaining abutment inside the keepers 28 and opposes displacement of the door-halves.

The bolt 24 co-operates with a retraction spring 26 disposed about the shaft 25 and storing energy when the bolt 24 is in its closed position.

A locking piston 20 guided in a guide part 24 to move along a vertical direction perpendicular to the pivot shaft 25 bears, in a locking position (FIG. 1), against the rear face of the second portion 24*b* of the bolt 24.

The piston 20 is prevented from retracting by a toggle mechanism including a first link 15 pivoting about a first horizontal axis 18 perpendicular to the displacement direction of the piston 20, and to the shaft 25 of the bolt.

The pivot axis 18 of the first link 15 is fixed in position relative to the support plate 19. A second link 17 is hinged to the moving link 15 about a moving axis 16. The second link 17 is also hinged relative to the locking piston 20 about a third moving axis 22. The axes 18, 16, and 22 are parallel to one another and they are substantially in alignment with the axis of the piston 20 when in its locking position of FIG. 1. In this locking position, energy is also stored in a toggle-collapsing spring 23 extending between the hinge axes 18 and 22.

The lower link 17 includes an extension 17*a* which projects beyond the hinge axis 16 towards the upper link 15. The extension 17*a* of the lower link 17 is disposed, in the locked position of the locking device of FIG. 1, to face a cam 30 which is integral with a locking arm 7 and is disposed about the pivot axis 50 of the locking arm 7. The fixed pivot axis 50 is likewise parallel to the axes 18, 16, and 22. The unlocking arm 7 co-operates with an unlocking spring 10 disposed about the axis 50, and at its free end it also includes a retaining disk 8 for co-operating with an electromagnet 9.

An electric motor 1 drives a set of cams 2 including at least one resetting cam 3 and one locking cam 11. The resetting cam 3 co-operates with a resetting lever 4 whose free end acts on a resetting pusher 5 disposed horizontally and having a return spring 6 wound thereabout. The end of the resetting pusher 5 distant from the resetting lever 4 is intended to act on the unlocking arm 7.

The locking cam 11 co-operates with a locking lever 12 whose free end acts on a locking pusher 13 having a return spring 14 wound thereabout. The free end of the locking pusher 13 distant from the locking lever 12 is intended to act on the upper, first link 15.

The pushers 5 and 13 may lie in substantially the same horizontal plane. FIG. 6 shows one example of the disposition of the cams 3 and 11, and of the levers 4 and 12 with which they co-operate. FIGS. 6 also shows the presence of a positioning microswitch 31, a secure-position microswitch 32, and a secure-position cam 33 which are driven by the electric motor 1 together with the cams 3 and 11 in the set of cams 2.

The operation of the locking device of FIGS. 1 to 6 is now described.

The description begins with the operation of the locking device while locking the emergency exit, and described with reference to FIG. 1.

The motor and stepdown gear 1 is powered by a controlling electrical voltage and rotates the set of cams.

By virtue of their eccentricity, the cams push the levers and then stop in positions which free these levers and enable them to return to their starting positions under drive from their respective return springs.

Thus, the resetting cam 3 pushes the resetting lever 4 which in turn pushes the resetting pusher 5 and compresses its return spring 6. The free end of the resetting pusher 5 distant from the resetting lever 4 bears against the unlocking arm 7, and at the end of its stroke causes the retaining disk 8 fixed on the arm 7 to engage the active face of the electromagnet 9. The electromagnet fixed on the support plate 19 is powered electrically under remote control and while it is being powered, it holds the unlocking arm 7 against the force of the unlocking spring 10.

With a small delay relative to the resetting cam 3, the relocking cam 11 acts on the relocking lever which pushes the relocking pusher 13 and compresses its return spring 14. The free end of the relocking lever 13 bears against the upper link 15 practically level with its hinge axis 16 connecting it to the lower link 17.

The upper link 15 pivots about an upper axis 18 which is fixed in position relative to the support plate 19, thereby entraining the lower link 17 in movement which tends to close the angle between them when in the unlocked position (FIG. 2.) The angle between the two links 15 and 17 thus passes from a starting position of about 120° to a straight line position.

The lower link 17 is hinged to the locking piston 1 which is guided vertically by the guide part 21. The hinge axis 22 between the lower link 17 and the locking piston 20 thus moves along a vertical line passing through the fixed upper axis 18. The movement which realigns the two links simultaneously stores energy in the toggle-collapsing spring 23 placed beneath them.

The movement of the links coming back into alignment pushes the relocking piston 20 downwards. This piston bears against the bolt 24 which pivots about its upper shaft 25, compressing its retraction spring 26. Pivoting of the bolt 24 causes the portion **24*a* of the bolt 24 to penetrate into the corresponding cavities 27 in the two keepers 28**, each fixed on a corresponding one of the halves of the swing door.

Advantageously, the hinged assembly comprising the locking piston 20 and the links 15 and 17 bears at the end of this stroke against an eccentric pivoting abutment 29. This abutment is adjusted to enable the assembly to move a few degrees past exact alignment. By having such a small negative angle in combination with the action of the ejector spring 23, all three parts 15, 17, and 20 are given a position of stable equilibrium which they retain after the relocking pusher 13 has been retracted.

The locking operation is terminated when the unlocking arm 7 is held by means of its disk 8 against the electromagnet 9 and with the three axes 18, 16, and 22 in alignment. In this position, any thrust exerted on the bolt 24 by the door bears against the alignment of these axes, and the thrust is resisted by virtue of the strength of the parts constituting the hinge assembly.

An unlocking operation providing positive safety is now described with reference to FIG. 2. Positive safety operation takes place when the public is present on premises fitted with the locking device of the invention. Under these circumstances, unlocking is performed merely by the action of stored energy (in a spring) and it is triggered by an interruption of the feed current, in particular the current feeding the electromagnet 9.

Door unlocking is triggered on the electromagnet 9 releasing the unlocking arm 7 by virtue of the feed to the electromagnet being interrupted.

When the electromagnet 9 is unpowered, the unlocking spring 10 is released and it expels the unlocking arm 7 suddenly from the position in which it was held.

The eccentric cam 30 coupled to the shaft of the arm 7 strikes the extension **17*a* of the lower link 17, thereby breaking the alignment of the three axes 18, 16, and 22. The shock caused by the momentum of the mass constituted by the retaining disk 8 at the end of the unlocking arm 7** has a major contribution to breaking the equilibrium position.

Thereafter the toggle-collapsing spring 23 takes over and closes the angle between the two links 15 and 17. The locking piston 20 rises under traction from the links 15 and 17 driven by the toggle-collapsing spring 23. This extracts the portion **24*a* of the bolt 24 from the latching cavity 27 in the keepers 28 under drive from the retraction spring 26**.

If, at the unlocking instant, the door is simultaneously exerting pressure against the face **24*c* of the portion 24*a* of the bolt 24**, then this pressure assists in retracting the bolt rather than hindering such retraction.

FIG. 3 shows the locking device in its secure position, i.e. in its position for providing negative safety when the public is not present on the premises fitted with the locking device. In the position of FIG. 3, the locking device is transformed into a lock that is secure against break-in and that will not become unlocked even if the electrical feed to the electromagnet 9 is interrupted.

During the initial locking operation, the action of the positioning cam 32 on the positioning microswitch 31 stops the electric motor 1 after it has rotated sufficiently to release the pushers 5 and 13 and enable them to return to their starting positions under thrust from their respective return springs 6 and 14.

The secure position is obtained by rotation of the motor 1 under control of the security cam 33 on the secure-position microswitch 34. The motor 1 stops so as to hold the resetting pusher 5 bearing against the unlocking arm 7, and the relocking pusher 13 bearing against the upper link 15.

In this position, releasing the electromagnet 9 does not cause the door to become unlocked. The only way to unlock the door is to rotate the set of cams 2 further and to interrupt feed to the electromagnet 9.

The electrical locking device for an emergency exit of the present invention thus indeed satisfies the following three requirements:

when the public is present on premises equipped with the invention and the power supply to the door is interrupted, then the door is unlocked by the action of the stored energy, but so long as the power supply is maintained, then the door provides the same resistance to break-in as a high-security lock;

the door is guaranteed to open even if significant pressure is being exerted thereon while the bolt is being unlocked; and when the public is not present on the premises, the door continues to be locked even in the event of the power supply being interrupted, with it still being possible to unlock the door by applying a special door-unlocking command, and with the lock continuing to apply resistance to break-in equivalent to that of a high-security lock.

Reference is now made to FIGS. 7 to 10 which show a second embodiment of a locking device for an emergency exit, which second embodiment is very similar in structure and in operation to the first embodiment, but nevertheless has a few differences, particularly with respect to the mechanisms for resetting and for locking.

In FIGS. 7 to 10, items which are identical to items already described with reference to FIGS. 1 to 6 are given the same reference numerals and they are not described again.

Figure 7:
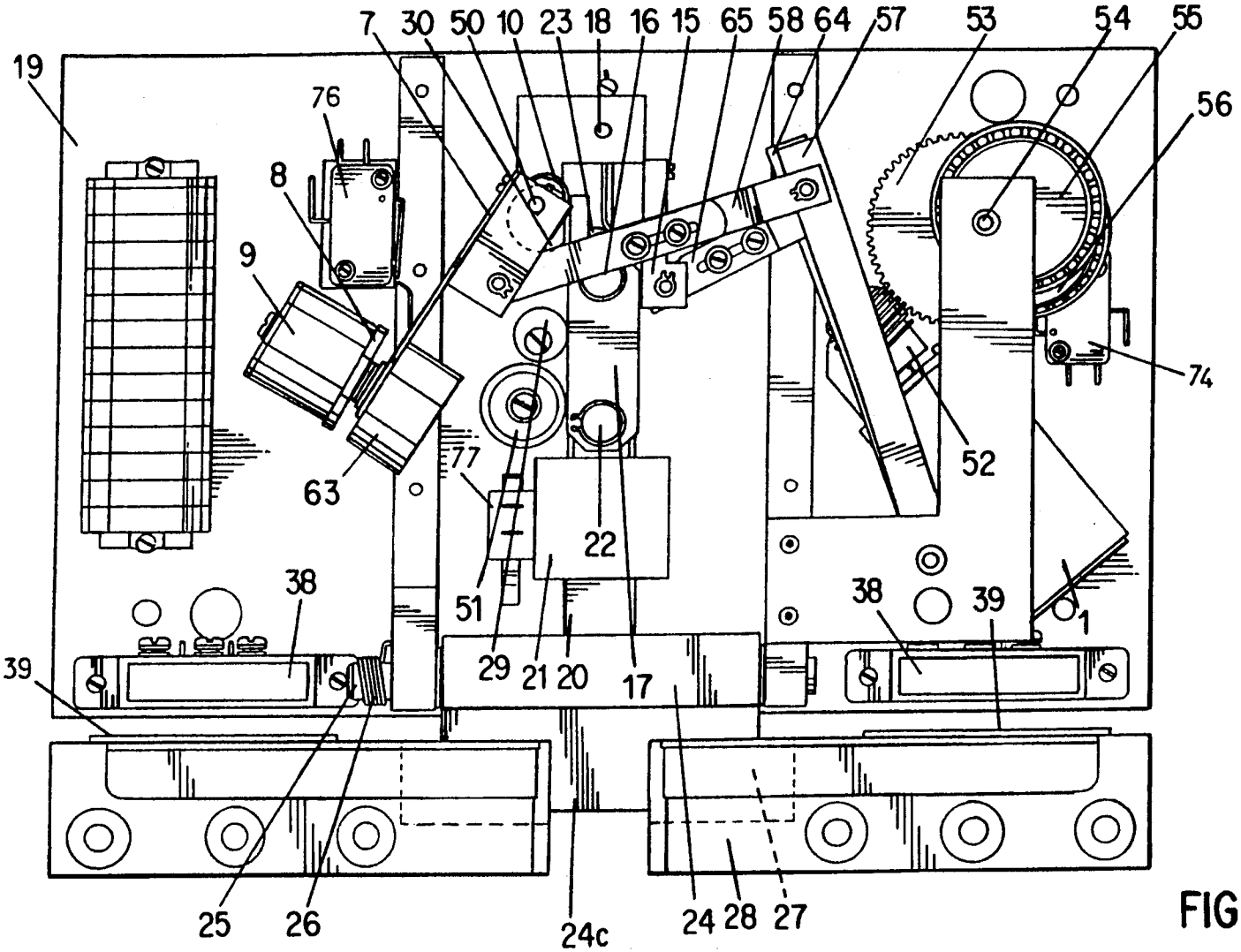
FIG. 7 is a front showing a second embodiment of a locking device of the invention, the device being in its locked position.

In FIG. 7, there can be seen an unlocking weight 63 fixed to the end of the unlocking arm 7 so as to increase the striking force of the unlocking arm 7 when it causes the cam 30 to break the equilibrium alignment position of the links 15 and 17.

Figure 8:
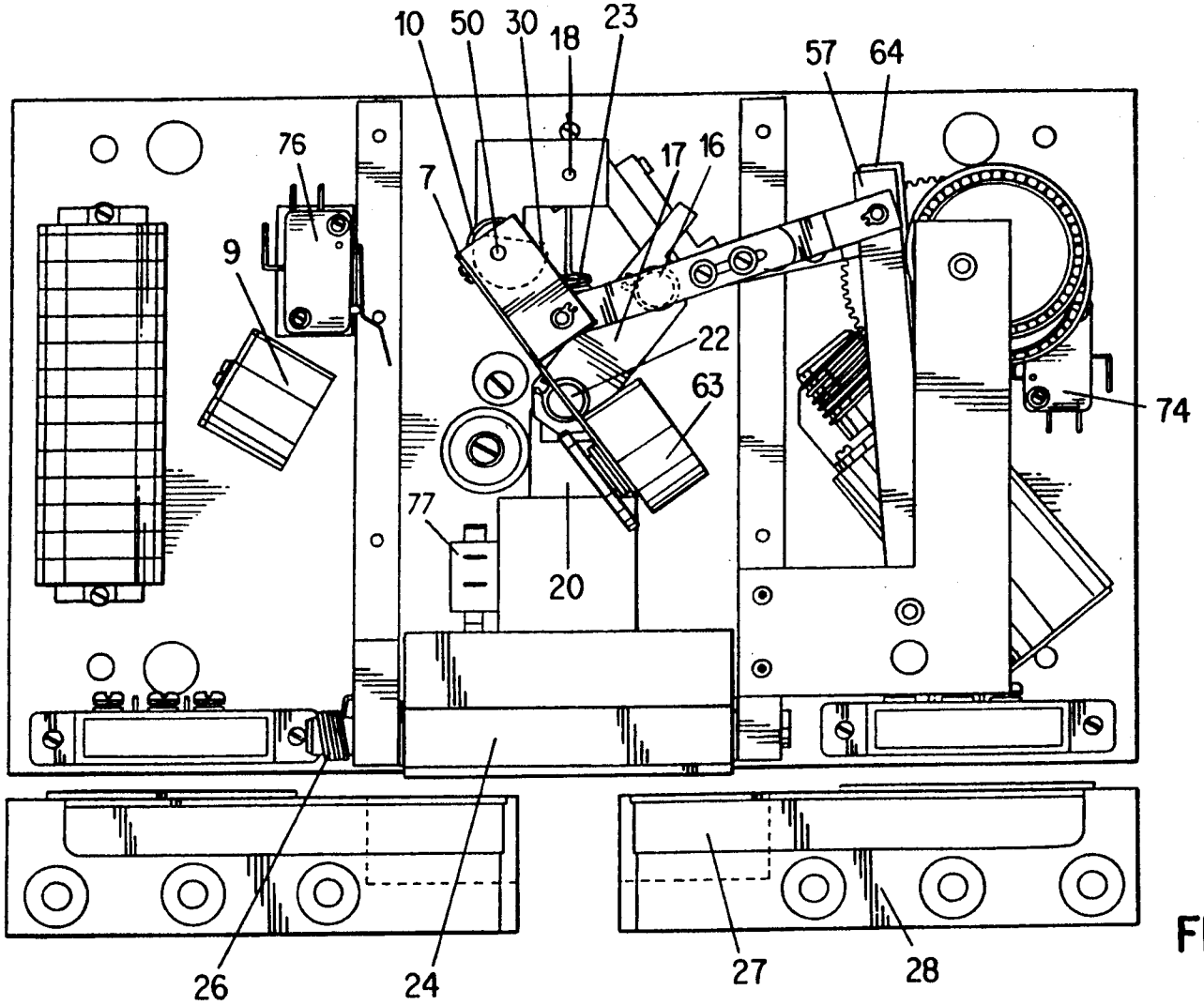
FIG. 8 is a view analogous to FIG. 7, showing the locking device in its unlocked position.
Figure 9:
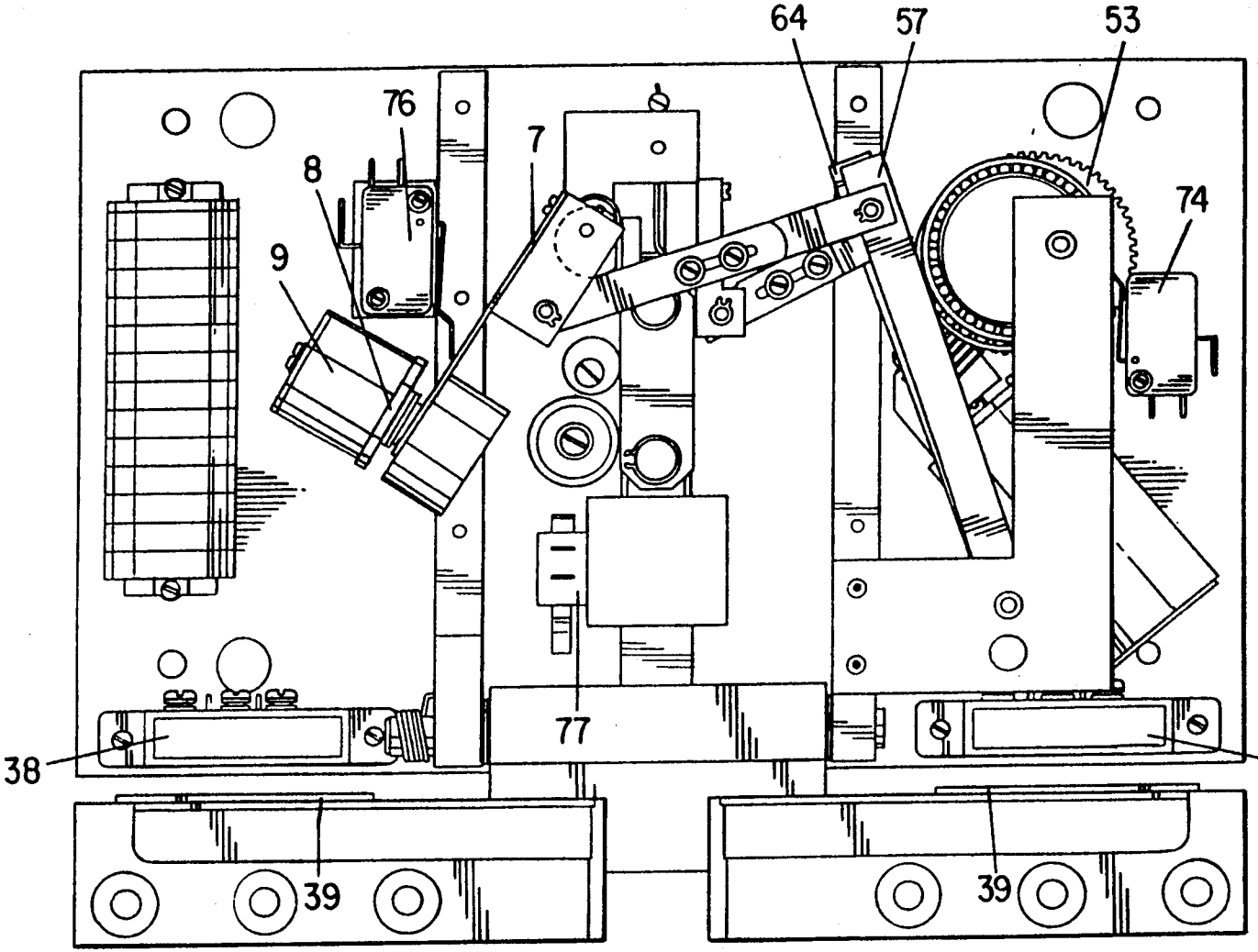
FIG. 9 is a view analogous to FIGS. 7 and 8 showing the locking device in its secure position.
Figure 10:
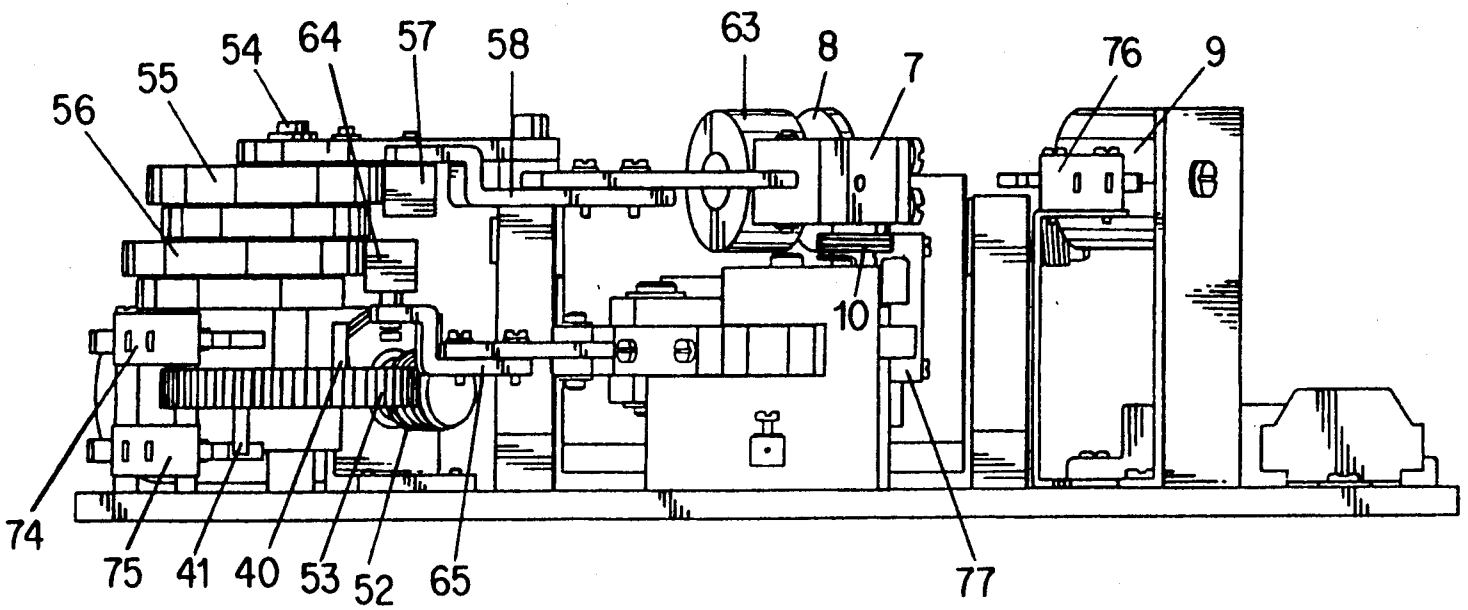
FIG. 10 is a top end view of the locking device of FIGS. 7 to 9.

FIGS. 7 to 9 also show the keepers 28 with which the bolt 24 co-operates, and two magnetic contacts 38 can be seen disposed on the plate 19 facing two permanent magnets 39 placed on the keepers 28 to signal that the two halves of the door are in the closed position.

FIGS. 7 to 9 also show the presence of a resetting microswitch 76 disposed in the vicinity of the unlocking arm 7 and of the electromagnet 9, together with a locking microswitch 77 disposed in the vicinity of the piston 20, these microswitches 76 and 77 being for the purpose of signalling the positions of the various moving parts of the locking device.

FIGS. 7 to 10 show that the electric motor 1 has an outlet shaft which is coupled to a worm screw 52. This screw 52 engages a drive gear 53 whose shaft constitutes the cam shaft 54 and thus constitutes a common shaft for the resetting cam 55 and for the locking cam 56.

The resetting cam 55 co-operates with a resetting lever 57 which is hinged to a resetting link 58 which is in turn hinged to the unlocking arm 7.

The locking cam 56 co-operates with a locking lever 64 which is hinged to a locking link 56 itself hinged to the upper link 15.

An end-of-stroke microswitch 74 and a security microswitch 75 are disposed in the vicinity of the cams 55 and 56 and cooperate with studs placed on the drive gear 53 to switch off the electric motor 1 in predetermined positions.

Reference is now made more particularly to FIG. 7 to describe setting the variant of the locking device shown in FIGS. 7 to 10 in its locking position.

Rotation of the motor 1 causes the drive gear 53 to rotate together with the cams 55 and 56.

As it rotates, the resetting cam 55 bears against the resetting lever 57 which moves away from its rest position, thereby pushing back the unlocking arm 7 via the resetting link 58. Rotation of the unlocking arm 7 about its axis 50 compresses the unlocking spring 10 which is wound around this axis. At the end of its stroke, at the maximum projection of the resetting cam 55, the retaining disk 8 comes into contact with the active face of the electromagnet 9. The electromagnet is then powered so it retains the retaining disk 8 thereagainst while the resetting cam 55 continues to rotate and releases the resetting lever 57.

When the resetting cam 55 releases the resetting lever 57, the locking cam 56 (which began to rotate simultaneously therewith), begins to bear against the locking lever 64. Via the locking link 65, the locking lever 64 pushes the upper link 15 level with the middle hinge axis 16 where it is hinged to the lower link 17.

Like the embodiment shown in FIGS. 1 to 6, the upper link 15 then pivots about the upper hinge axis 18 and drives the lower link 17 in motion which tends to close the angle that it used to form therewith in the unlocked position.

The lower link 17 hinged to the locking piston 20, itself guided in a vertical direction by the guide part 21, causes the piston 20 to move downwards. As it moves, the locking piston 20 bears against a ball bearing 51 which constitutes a thrust bearing exerting pressure to compensate the lateral thrust engendered by the action of the locking link 65 on the upper link 15.

The hinge axis 22 between the lower link 17 and the locking piston 20 moves onto a vertical line passing through the stationary upper hinge axis 18. The movement which realigns the two links of the toggle mechanism simultaneously stores energy in the toggle-collapsing spring 23 placed beneath them.

On being realigned, the links push the locking piston 1 downwards, thereby engaging the bolt 24 in the keepers 28.

As in the first embodiment, the hinge assembly constituted by the links and the locking piston 20 preferably bears at the end of the locking stroke against an eccentric pivoting abutment 29 which is disposed in such a manner as to allow the assembly to go a few degrees past accurate alignment so as to define an equilibrium position which is stable and which is maintained after the locking cam 56 has withdrawn.

FIG. 7 shows the locking device at the end of the locking operation when the locking arm 7 is held by means of its plate 8 against the electromagnet 9 and with the three axes 18, 16, and 22 substantially in alignment.

FIG. 8 shows the second embodiment of the locking device in an unlocked position where it is operating with positive safety, i.e. it is in its operating position applicable when the public is on the premises fitted with the locking device.

When the feed to the electromagnet 9 is interrupted, the electromagnet 9 releases the unlocking arm 7 which is driven by the unlocking spring 10 to move away from the position in which it was held. The unlocking eccentric 30 coupled to the axis 50 of the arm 57 engages the lower link 17, thereby moving the three axes 18, 16, and 22 out of alignment. The shock from the momentum of the mass represented by the unlocking weight 63 fixed at the end of the unlocking arm 7 contributes to ensuring that the links are moved reliably and clearly away from their equilibrium position.

The angle between the two links 15 and 17 closes under the action of the toggle-collapsing spring 23, and the locking piston 20 rises under traction from the links 15 and 17 driven by the toggle-collapsing spring 23. The hook-shaped bolt 24 thus withdraws from the hooking cavities 27 and thus from the keepers 28 under the action of the retraction spring 26, as in the first embodiment.

FIG. 9 shows the second embodiment of the locking device of the invention in its secure position, i.e. in its negative safety operating position suitable for the public being absent from the premises fitted with the lock of the invention.

During initial locking, the motor 1 is stopped by the action of a stud 40 (FIG. 10) placed on the drive gear 53 and engaging the end-of-stroke microswitch 74. A second stud 41 (FIG. 10) also placed on the drive gear 53 serves to stop the cams at their maximum projection positions by engaging the secure-position microswitch 75 so as to prevent the action of the unlocking arm 7 and prevent the three axes being taken out of alignment should the electromagnet 9 release the retaining disk 8. This position constitutes the secure position.

Reference is now made to FIGS. 11 to 14 while describing a third embodiment of the locking device of the invention for an emergency exit.

The embodiment of FIGS. 11 to 14 is very similar to that of FIGS. 7 to 10. Similar items are given the same reference numerals and are not described again.

In the embodiment of FIGS. 11 to 14, a coil spring 78 is disposed between the unlocking arm 7 and a fixed point adjacent to the resetting lever 57 and the locking lever 64.

The spring 78 may replace the spring 10 of the embodiment shown in FIGS. 7 to 10 or it may be addition thereto so as to reinforce the efficiency of unlocking which can thus be obtained not only by the effect of gravity on the unlocking arm 7, but also by the action of return springs.

The embodiment of FIGS. 11 to 14 also shows that the electric motor 1 is disposed somewhat differently from the above-described embodiment, making it possible to implement a stepdown gear box constituted by a set of gears 80 placed at the outlet from the electric motor 1. One of the gears 80 is fixed to a shaft carrying the toothed wheel 53 which is no longer directly engaged with the outlet of the motor 1, and another one of the gears 80 is fixed to the shaft carrying the resetting cam 55.

A torque limiter may be inserted, for example, in the gear 80 fixed to the shaft carrying the resetting cam 55 to provide the motor with mechanical protection should the bolt 24 jam during locking.

Figure 11:
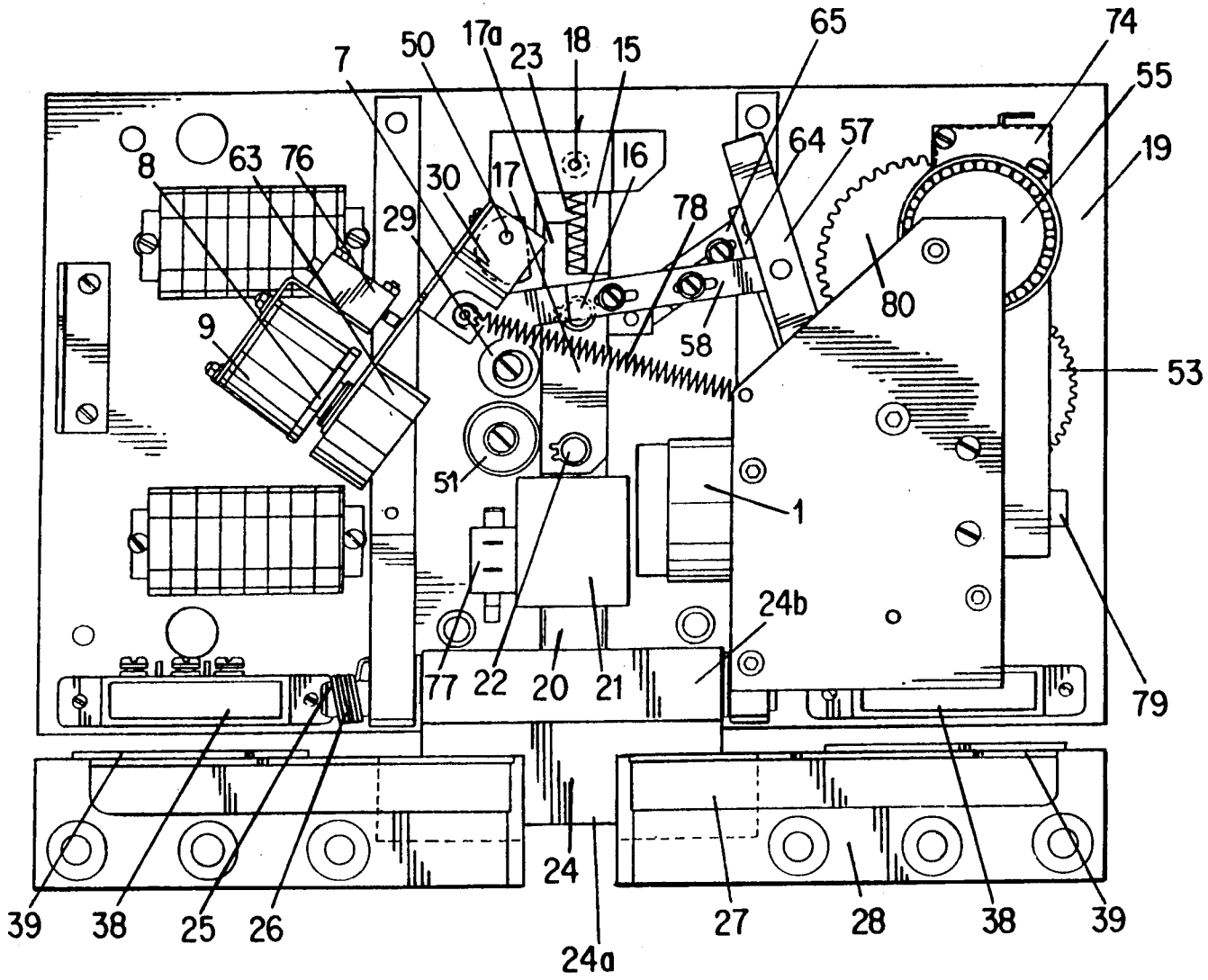
FIG. 11 is a front view of a third embodiment of a locking device of the invention, the device being shown in its locked position.
Figure 12:
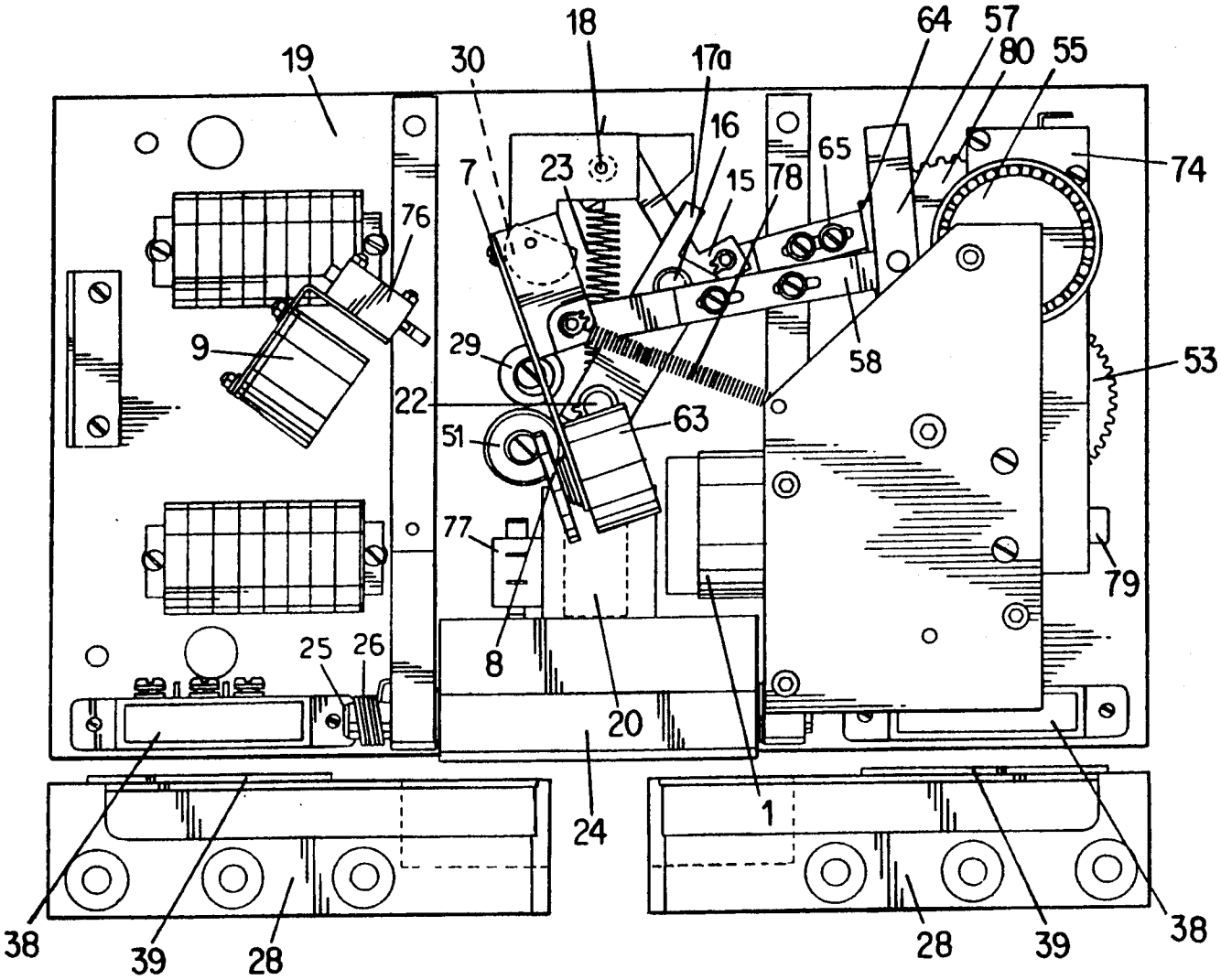
FIG. 12 is a view analogous to FIG. 11, but showing the locking device in its unlocked position.
Figure 13:
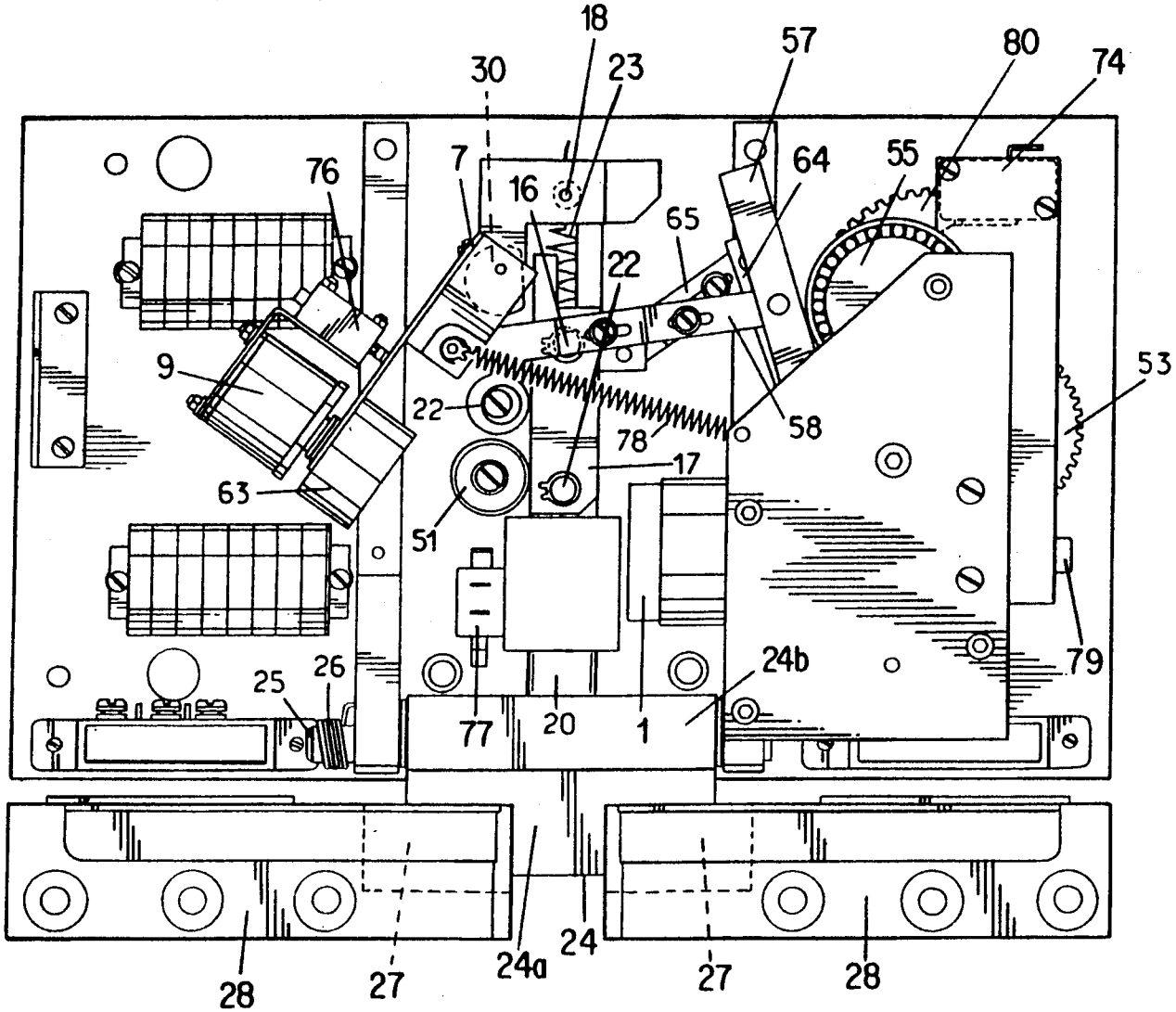
FIG. 13 is a view analogous to FIGS. 11 and 12 but showing the locking device in its secure position.

As can be seen in FIGS. 11 to 13, a slot 79 placed at the end of the shaft of the motor 1 makes it possible to change state under control of a manual or an electrical screwdriver, in the event of the motor 1 being faulty.

In the embodiment of FIGS. 11 to 14, the microswitches 74 and 75 are controlled by respective cams 82 and 83 (FIG. 14), whereas in the embodiments of FIGS. 7 to 10, the microswitches 74 and 75 are controlled by respective studs on the same toothed wheel 53.

Figure 15A:
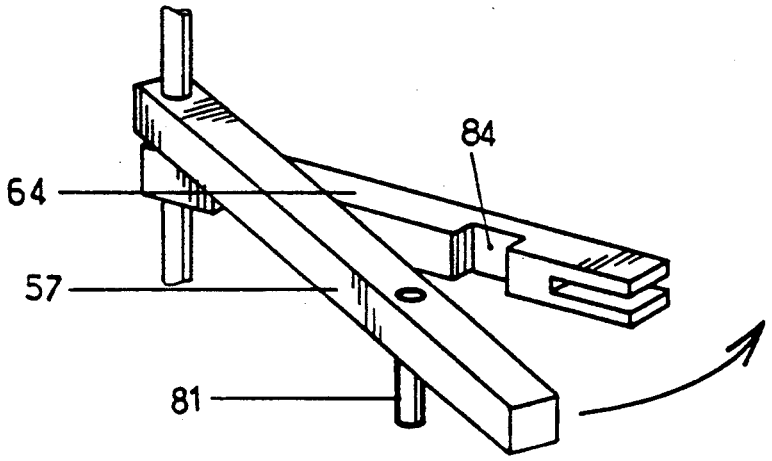
FIGS. 15A and 15B are perspective views of the resetting lever and of the locking lever implemented in the embodiment of FIGS. 11 to 14, and shown in two different successive positions.
Figure 15B:
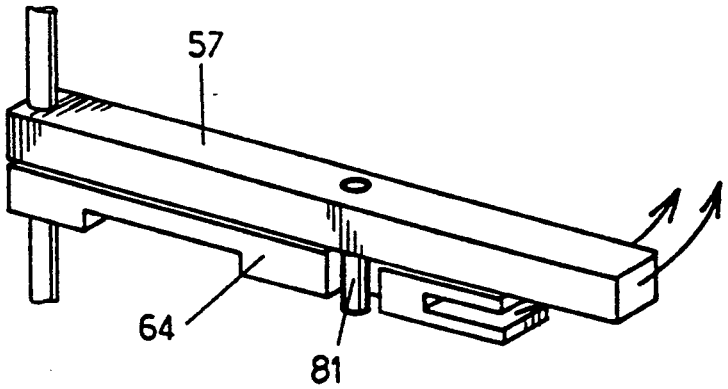
Figure 14:
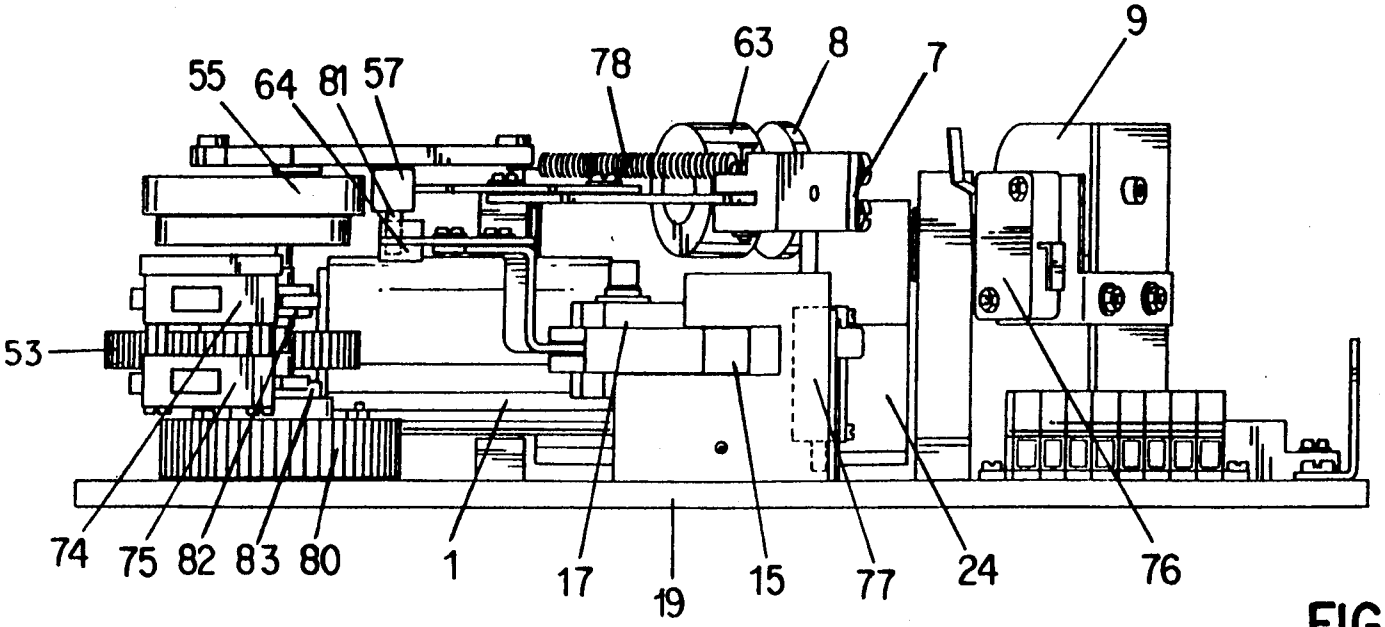
FIG. 14 is a rear end view from above showing the locking device of to FIGS. 11 to 13.

Another special feature of the embodiment of FIGS. 11 to 14 is explained with reference to FIGS. 14, 15A, and 15B. The resetting lever 57 is provided with a peg 81 extending perpendicularly to the lever 57, which peg 81 is received in a notch 84 provided in the locking lever 64 during a resetting operation, thereby causing the lever 64 to be rotated by the resetting lever 57. This makes it possible to omit the locking cam 56 of the embodiment of FIGS. 7 to 10. When rotating in the opposite direction, i.e. the direction opposite to the direction of the arrows shown in FIGS. 15A and 15B, the peg 81 escapes from the notch 84 so that the resetting lever 57 under drive from the resetting cam 55 does not drive the locking lever 64.

Apart from the variants outlined above, the locking device of FIGS. 11 to 14 operates identically to the locking device of FIGS. 7 to 10.

Figure 16:
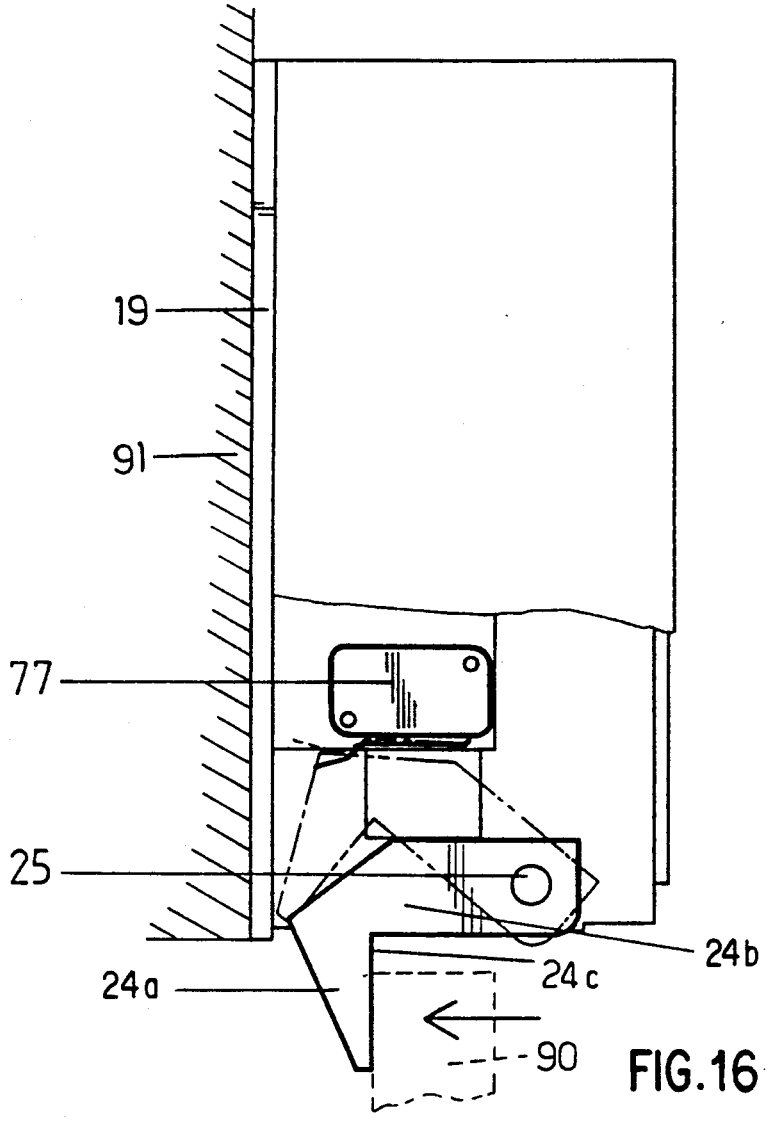
FIGS. 16 and 17 are respectively a diagrammatic elevation view and a perspective view of a locking device of the invention mounted in standard manner at the top of a door, on the frame thereof, with the bolt opening towards the installation plane.
Figure 17:
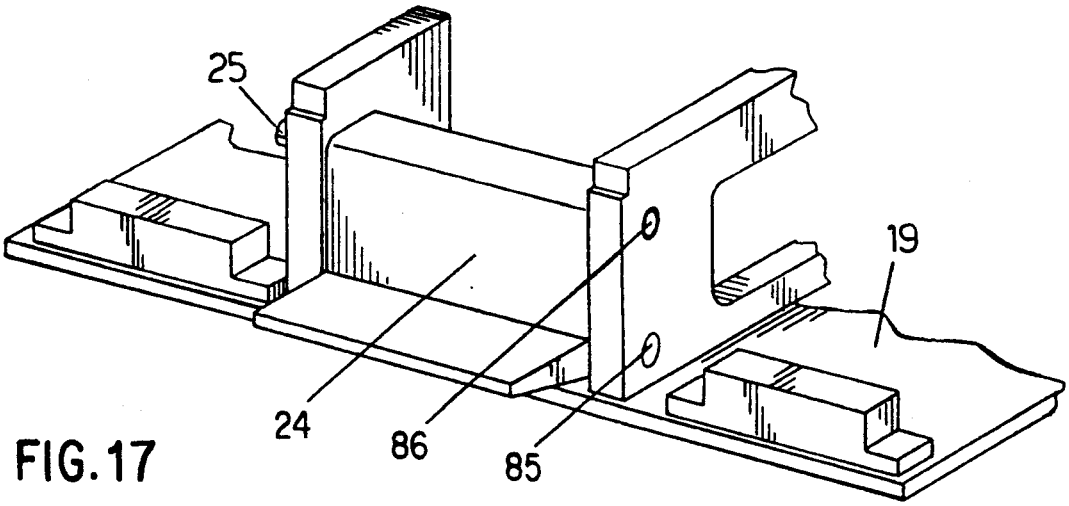

FIGS. 16 and 17 show a first example of how the locking device of the invention may be installed, with this example being applicable to the various embodiments described above.

This first method of installation may be considered as being the most common and is applicable to opening a door 90 towards the plane on which the bolt is installed. The base plate 19 is used to mount the body of the locking device vertically on the frame 91 of a door, while the keeper or keepers are mounted on the door 90 on its side facing the plate 19. Only one keeper face co-operates with the face **24*c* of the abutment-forming portion 24*a* of the bolt 24. The pivot shaft 25 of the bolt 24 is disposed in this case in an orifice 86 which is disposed at a position relatively distant from the base plate 19** of the locking device.

Figure 18:
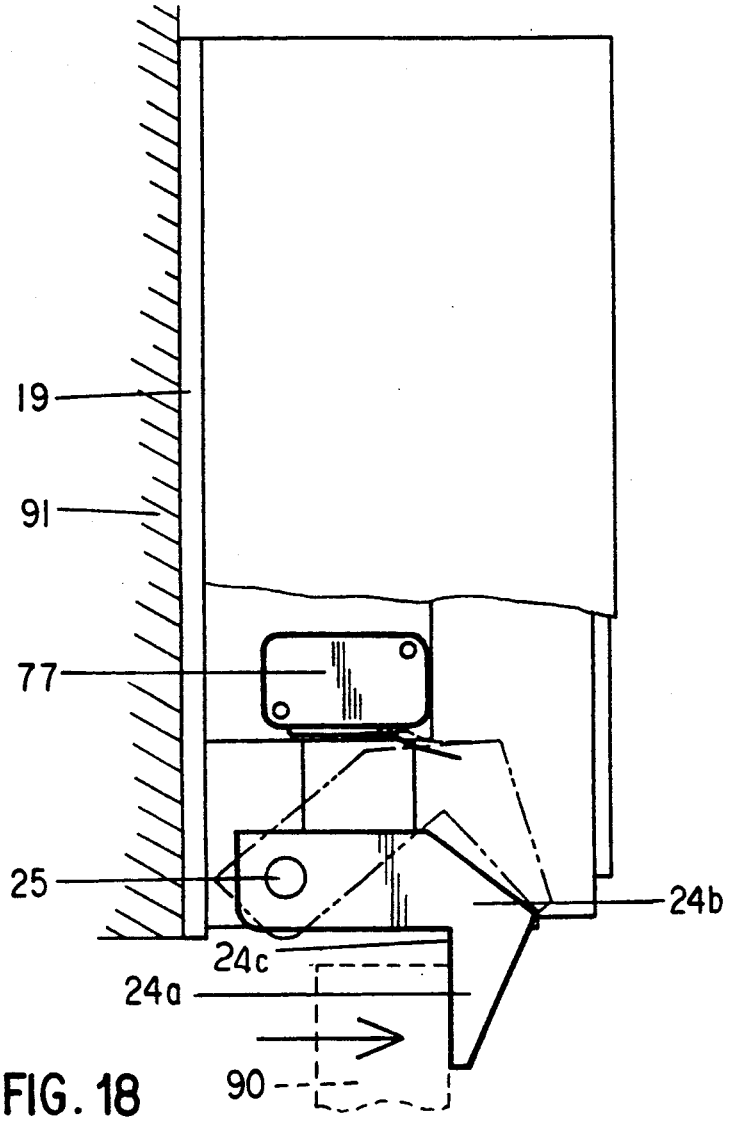
FIGS. 18 and 19 respectively a diagrammatic elevation view and a perspective view of a locking device of the invention mounted at the top of a door, with a reversed bolt that opens away from the installation plane.
Figure 19:
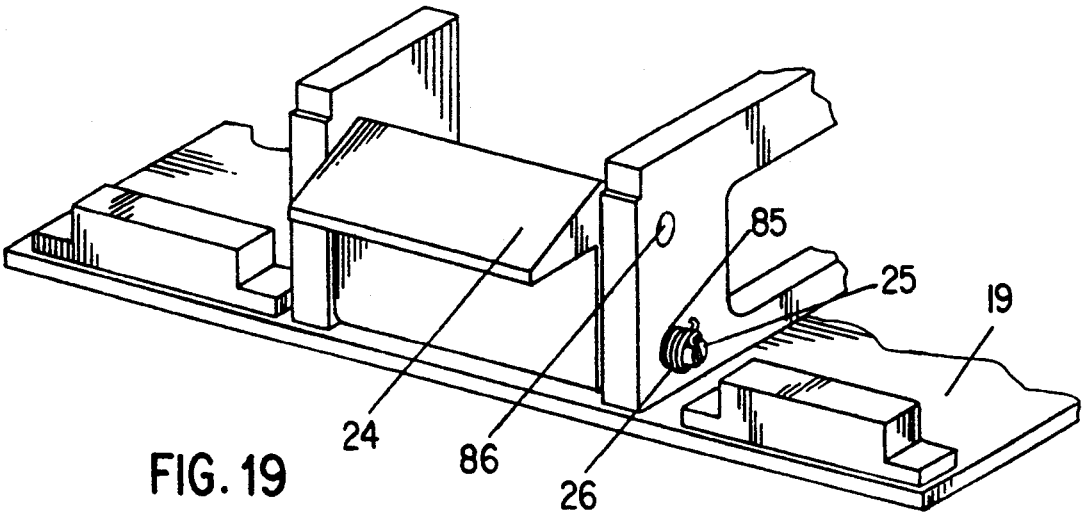

Other installations can nevertheless be envisaged. In the example of FIGS. 18 and 19 which constitute an "opposite" installation, the door 90 opens away from the plane on which the bolt is installed. Here again, the base plate 19 of the locking device is mounted vertically on the door frame 91 while the keeper or keepers are mounted on the door 90, this time on the face of the door facing away from the plate 19. In this case, the pivot shaft 25 of the bolt 24 is disposed in an orifice 85 which is close to the plate 19, such that the angled portion **24*a* of the bolt 24 is further from the plate 19 than is its pivot shaft 25, whereas in the embodiment of FIGS. 16 to 17, the angled portion 24*a* was specifically between the pivot shaft 24 and the plate 19**.

Figure 20A:
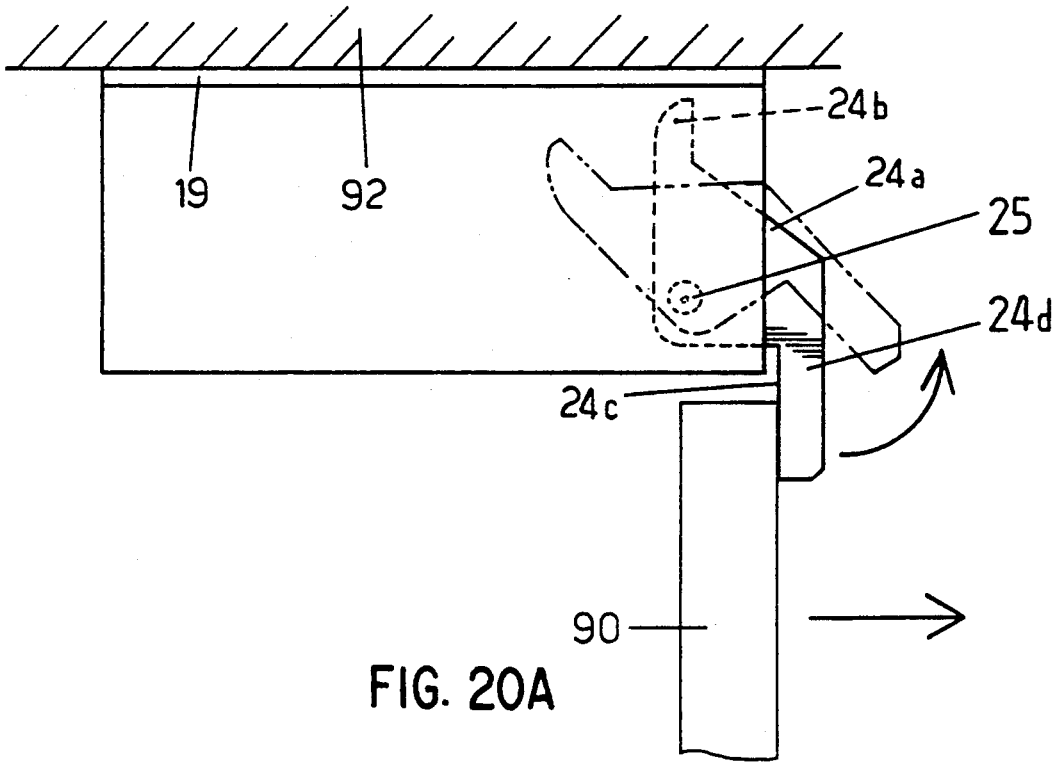
FIGS. 20A and 20B are respectively a diagrammatic elevation view and a perspective view of a locking device of the invention in the form of a bolt which is adapted to enable the locking device to be fixed to a ceiling, above the door to be locked.
Figure 20B:
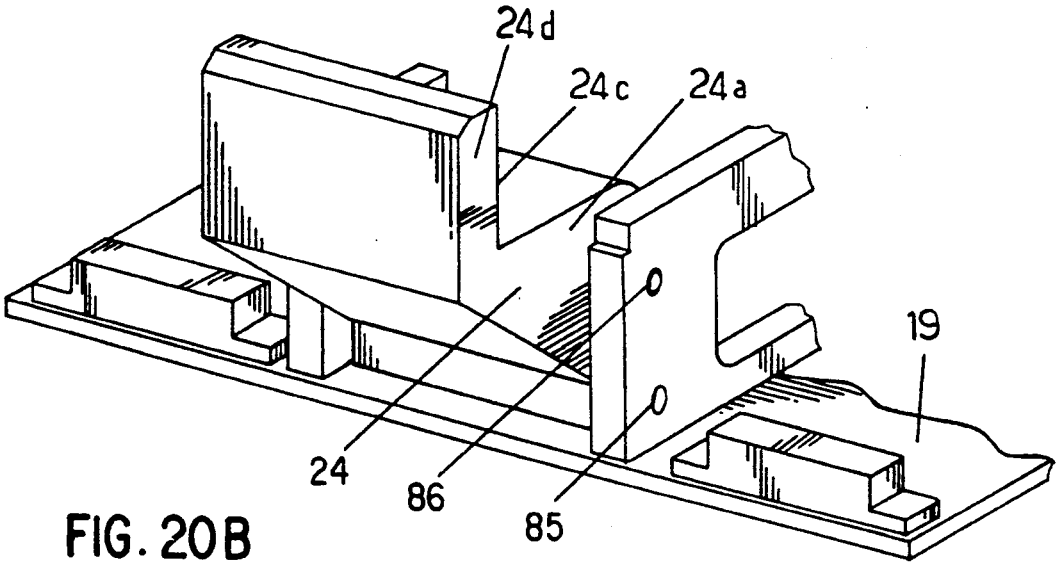

FIGS. 20A and 20B show yet another possible way of installing the locking device of the invention.

The installation shown in FIGS. 20A and 20B shows the locking device being installed by fixing its base plate 19 on a horizontal ceiling 92 situated above the door 90. In this case, which may be advantageous when the space between the door and the ceiling is small, the bolt 24 which pivots about a horizontal pivot shaft 25, e.g. located in an orifice 86 located relatively far from the plate 19, has a special shape.

The bolt 24 of the locking device suitable for the installation shown in FIGS. 20A and 20B is provided, as in the various embodiments described above, with a second portion that co-operates with a locking piston 20 and which is mounted to pivot about a horizontal pivot shaft 25, together with a first portion **24*a* which is essentially perpendicular to the second portion 24*b*. However, the pivot shaft 55 is placed in a junction zone between the first and second portions 24*a* and 24*b* of the bolt 24 instead of being in a zone that is at a distance from the first portion 24*a*. In addition, the first portion 24*a* is extended by a third portion 24*d* which is substantially perpendicular to the first portion 24*a* and parallel to the second portion 24*b*, and which points in the opposite direction thereto. The third portion 24*d* of the bolt 24 points downwards and has a plane face 24*c*** which constitutes the abutment that co-operates with the door 90. The opposite side to the third portion 24*d* has a sloping wall connecting the first portion 24*a* to the second portion 24*b* so as to establish a mechanically reinforced central region in the bolt 24.

In the above description it is assumed that the locking device is mounted by means of its base plate 19 on a fixed wall 91, 92 located in the vicinity of a door 90 while the keeper(s) or items acting as keepers have been disposed on the door 90.

Naturally, should that be necessary, these positions could be interchanged with the locking device then being mounted on the door itself.

The operating cycles of the second embodiment of the locking device of the invention are now described in greater detail with reference to FIGS. 21 to 36. It should nevertheless be understood that these operating cycles apply in similar manner to the first and third embodiments.

FIGS. 21 to 33 show the various different states of the control system for the electric motor 1 in different stages of the operating cycle of the locking device.

Electrical power is applied to the motor 1 via two contacts S01 and S02 connected in series, with the contacts S01 and S02 being constituted by the springs of respective relays K01 and K02. The relays K01 and K02 are controlled by respective control switches S03 and S04. The relay K01 is also controlled by a contact SW01 connected in parallel with the contact S03, the contact SW01 being connected to the end-of-stroke microswitch 74. The relay K02 is itself also controlled by a contact SW02 connected in series with the contact S04, the contact SW02 being connected to the secure position microswitch 75.

FIGS. 21 to 33 also show the studs 40 and 41 disposed on the drive gear 53 to co-operate with the microswitches 74 and 75. To simplify showing the microswitches, the drive gear 53 is shown twice over. The upper view of the gear shows the end-of-stroke stud or peg 40, while the lower view shows the secure-position stud or peg 41. In practice, these two studs 40 and 41 are fixed on a single gear 53 and they act on the microswitches 74 and 75 which are disposed around that single gear 53, but at positions that are offset. It would also be possible to provide other embodiments, as mentioned with reference to the embodiment shown in FIGS. 11 to 14.

In the following description made with reference to FIGS. 21 to 36, it will be observed that the secure position of the bolt (door locked, not unlockable by interrupting electrical current) constitutes an intermediate stage in the locking cycle. In other words, each bolt-locking cycle causes the various component parts to begin by taking up a secure position, and if the command to take up the secure position is not present, the parts continue to move until they finally take up a positive safety lock position (door locked, but unlockable on interrupting the current). The secure position is thus not obtained by means of an additional device independent from the device that locks the door. This contributes to simplifying the lock since it contains only one actuator, and it increases reliability insofar as there are no longer any problems of synchronization between various device nor is there any possible risk of two devices opposing each other when given contradictory instructions.

Figure 34:
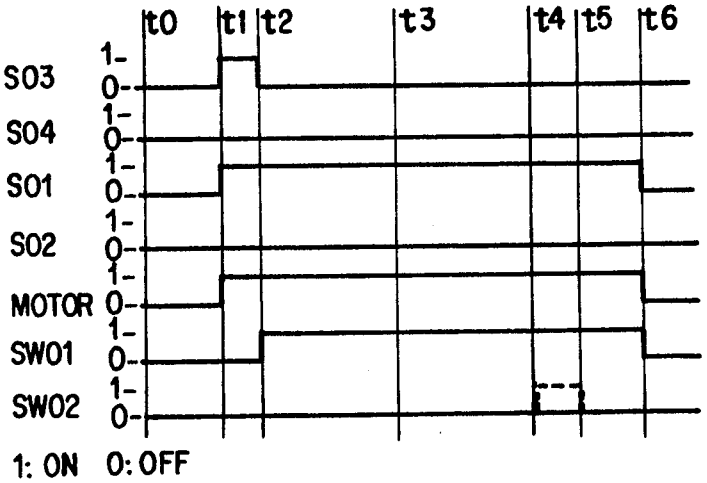
FIG. 34 is a timing diagram showing the states of the various parts of the electrical control circuit of the locking device of the invention during a locking cycle.

FIG. 34 is a timing diagram showing the various states of the contacts S01 to S04, the contacts SW01 and SW02, and of the electric motor 1 during a locking cycle. By convention, when a contact is active it is shown as being in state 1, whereas when the contact or the motor is at rest, it is shown as being at state 0.

FIGS. 21 to 36 show the state of the electric control circuit for the motor 1 at the various different instants t0 to t4 of FIG. 34.

Figure 21:
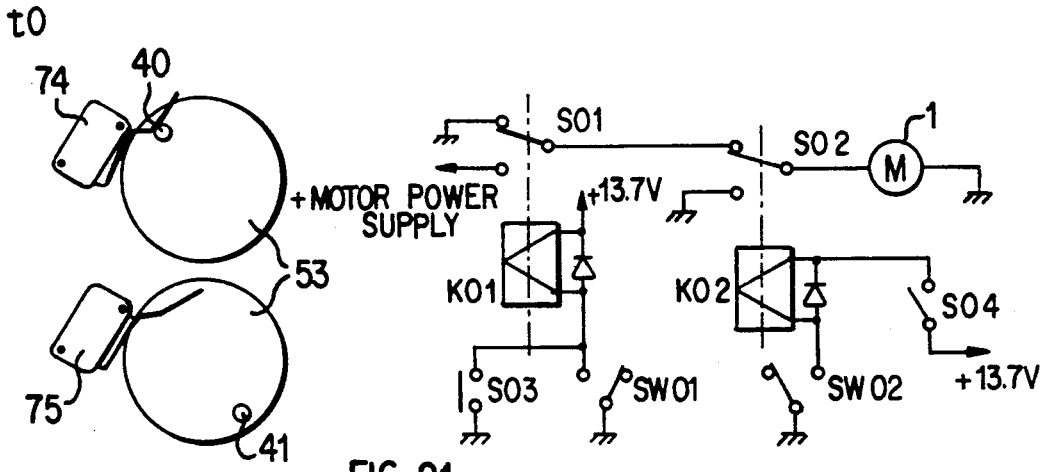
FIGS. 21 to 26 show various different states of the electrical control circuits of the locking device of the invention during a door-locking cycle, including a positive safety position.

FIG. 21 shows the bolt locking device at rest, at an instant t0 in a cycle for locking the door in a positive safety position.

The door has been unlocked by releasing the unlocking arm 7. All of the parts constituting the unlocking device have remained in the position reached at the end of the preceding resetting cycle. The same applies to the control device outside the bolt.

The electric motor 1 has been stopped by the stud 40 which is fixed on the drive gear 53 and which engaged the end-of-stroke microswitch 74. The contact SW01 is thus in its working position, i.e. it is open. The relays K01 and K02 are not activated, and their respective contacts S01 and S02 are at rest. The control switches S03 and S04 are open. The secure position microswitch 75 is free, i.e. the contact SW02 is in its rest position.

Figure 22:
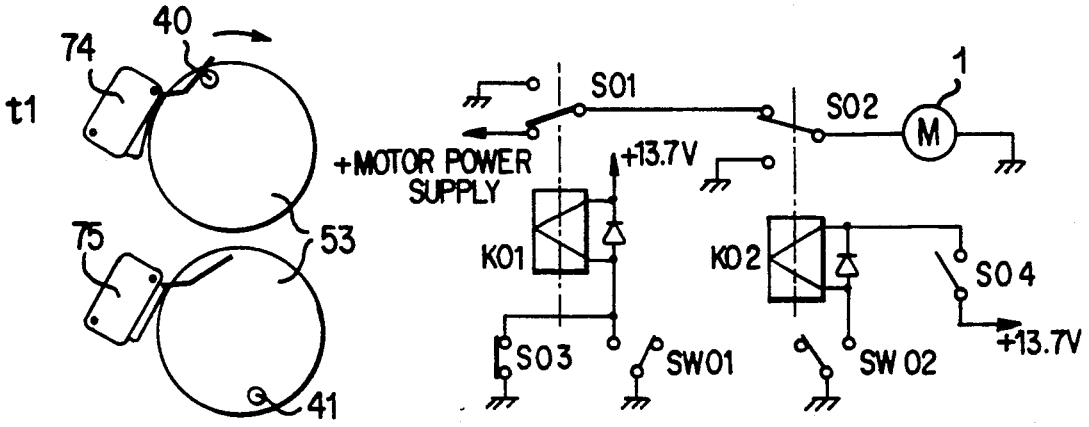

FIG. 22 shows the state at an instant t1 in the locking cycle, at the beginning of an instruction to lock the door.

The contact S03 closes, thereby actuating the relay K01. The contact S01 switches to its working position, i.e. it feeds electricity to the motor. The motor 1 is then powered, thus rotating the drive gear 53. The end-of-stroke stud 40 moves along the activation arm of the end-of-stroke microswitch 74 but does not release it immediately.

Figure 23:
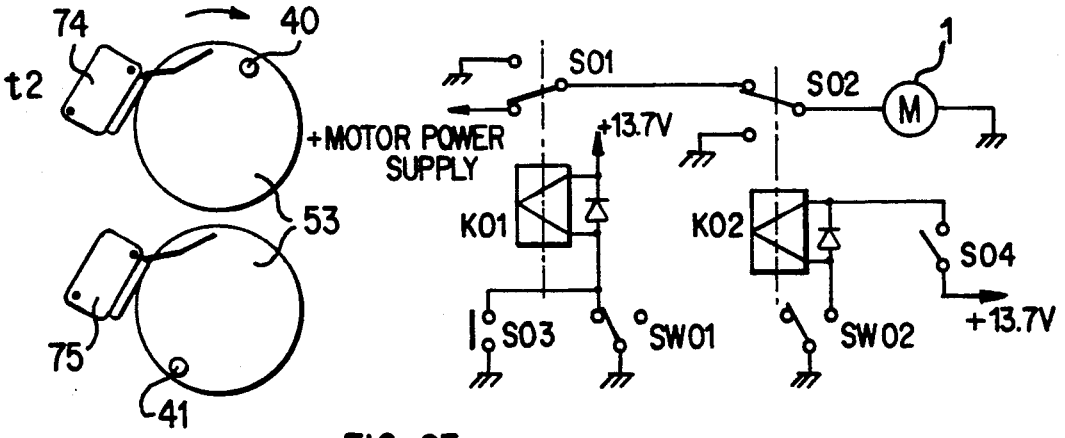

FIG. 23 shows a state at an instant t2 corresponding to the end of the door locking command.

The microswitch 74 has been released by the stud 40 and the locking control contact S03 may be released.

Figure 24:
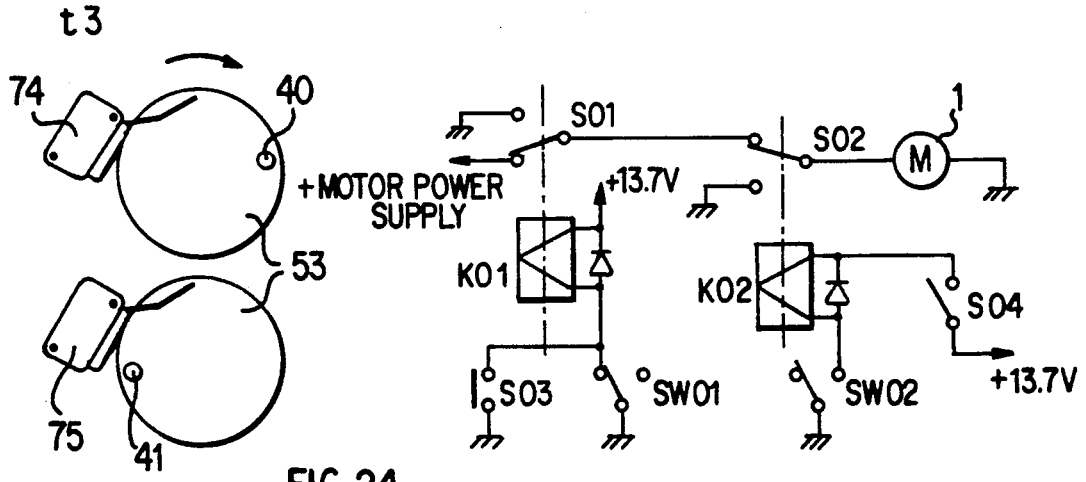

FIG. 24 shows the state at an intermediate instant t3 of the door locking cycle.

The motor 1 is rotating the gear 53, thereby displacing the studs 40 and 41. The various contacts remain in their preceding positions.

Figure 25:
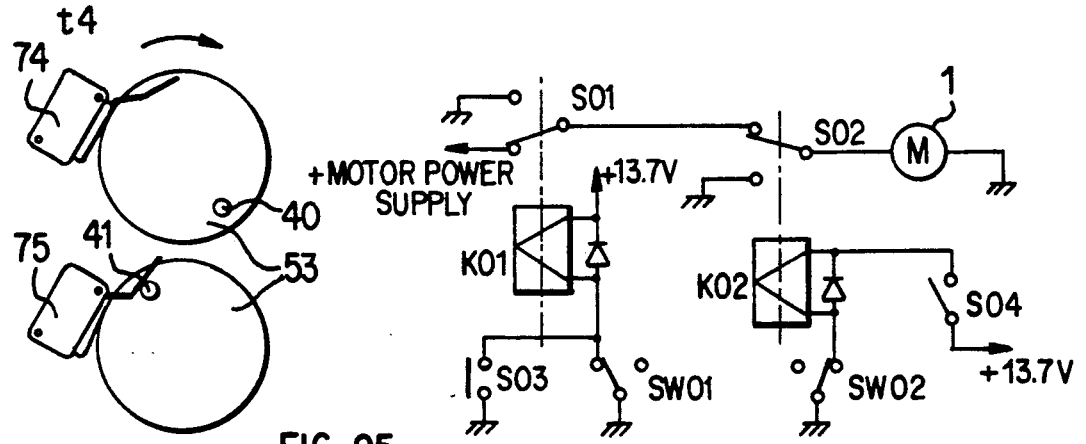

FIG. 25 shows the state at an instant t4 on beginning to pass to the secure position.

During rotation of the gear 53, the stud 41 reaches the control arm of the microswitch 53 and moves it. The contact SW02 goes to the working position. Since the contact S04 is open, the relay K02 which was not powered, remains unpowered.

At the end of passing to the secure position, i.e. at instant t5, the stud 41 has travelled all the way along the actuator arm of the secure-position microswitch 75, thereby releasing its switch mechanism. Contact SW02 returns to the rest position (see FIG. 26).

At the end of the door-locking cycle, the gear 53 has returned to its starting position shown in FIG. 21, after performing a complete rotation through 360°. The gear 53 actuates the microswitch 74 again. The contact SW01 switches to its working position. The relay K01 is deactivated and the contact S01 switches to its rest position, thereby short circuiting the motor 1 and causing it to stop immediately. From the control point of view, the situation has returned to the initial position of FIG. 21, however on this occasion the unlocking arm 7 is primed and the three axes 16, 18, and 22 are in alignment, such that the door is locked.

Taking up the secure position is now described with reference to FIG. 35 and FIGS. 27 to 31.

When the public is present on the premises, the bolt keeps the door locked. It is placed in a positive safety position which enables it to be unlocked immediately under remote control by cutting the feed to the electromagnet 9.

If the public has left the premises via a different exit, the bolt is put into the secure position, thus preventing the door unlocking in the event of its power being interrupted. While the locking device is going from one state to the other, the door remains permanently locked by the bolt.

If an unlocked door is to be put into the secure position, it is necessary to begin by performing a locking cycle as explained below with reference to FIGS. 21 to 26 and FIG. 34.

At the starting instant t0 of a cycle for putting the lock into the secure position, the bolt is in the rest state of the bolt locking device, similar to the configuration shown in FIG. 21, but the door is locked and the bolt is in its positive safety position.

Figure 27:
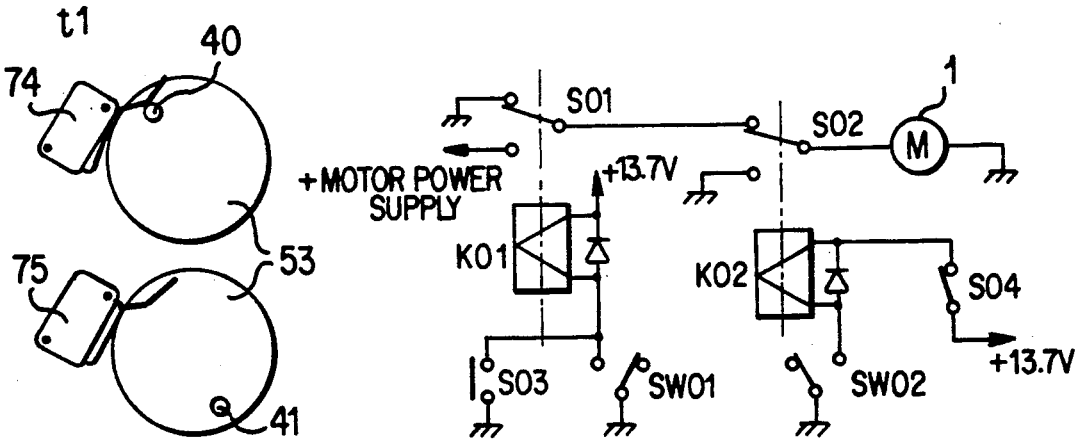
FIGS. 27 to 31 show different states of the electrical control circuits of the locking device of the invention during a cycle for putting the lock in a secure position.

FIG. 27 shows the states of the various components of the control circuit at an instant t1 at the beginning of a command to take up the secure position.

Contact S04 is closed, but no change is caused.

Figure 28:
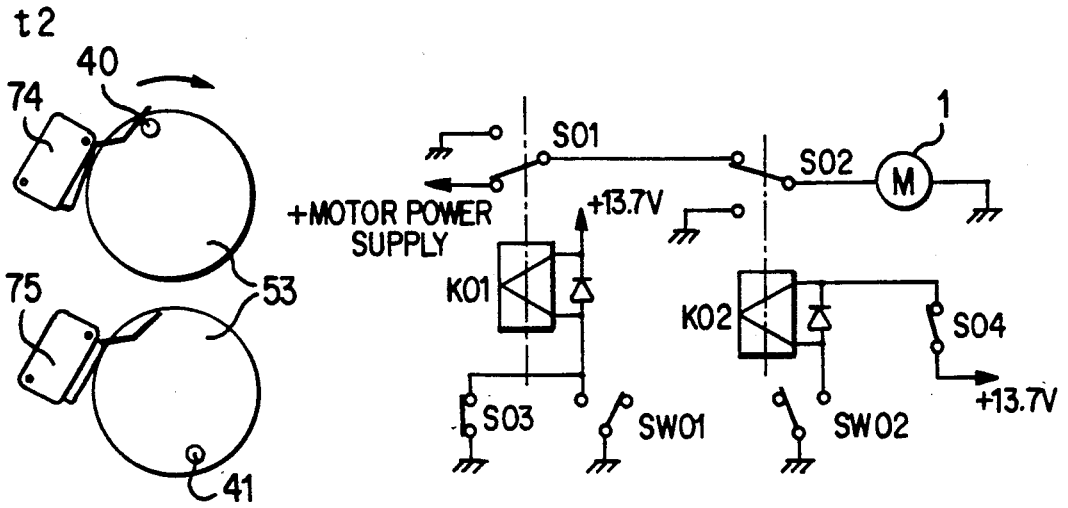

FIG. 28 shows the various contacts at an instant t2 corresponding to an intermediate stage of the command to take up the secure position.

Contact S03 is closed, thereby activating relay K01. Contact S01 switches over to the working position. The motor 1 is now powered and drives the gear 53. The studs 40 and 41 move.

Figure 29:
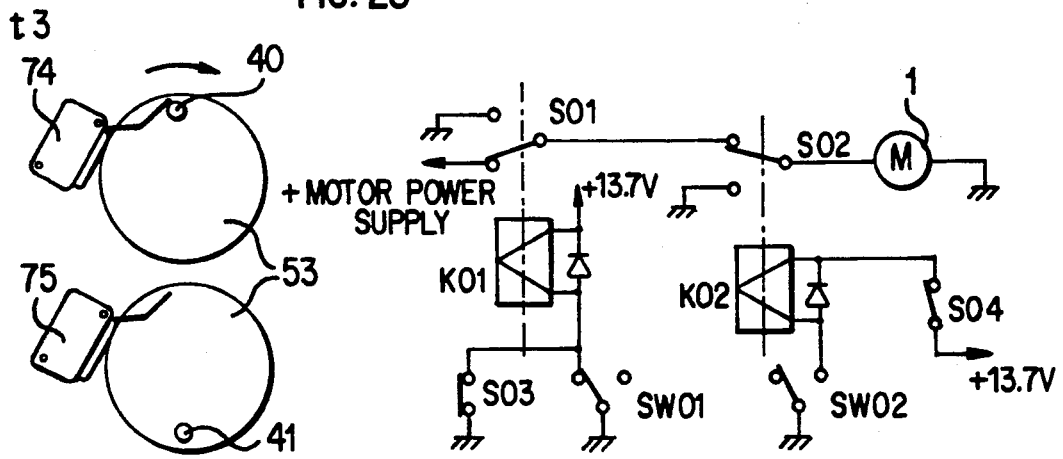

FIG. 29 shows the states of the various contacts at an instant t3 corresponding to the end of the command to take up the secure position.

Contact S03 is held closed while stud 40 runs along the activation arm of the microswitch 74. When the microswitch 74 is released, the switch SW01 switches to its rest position.

Figure 30:
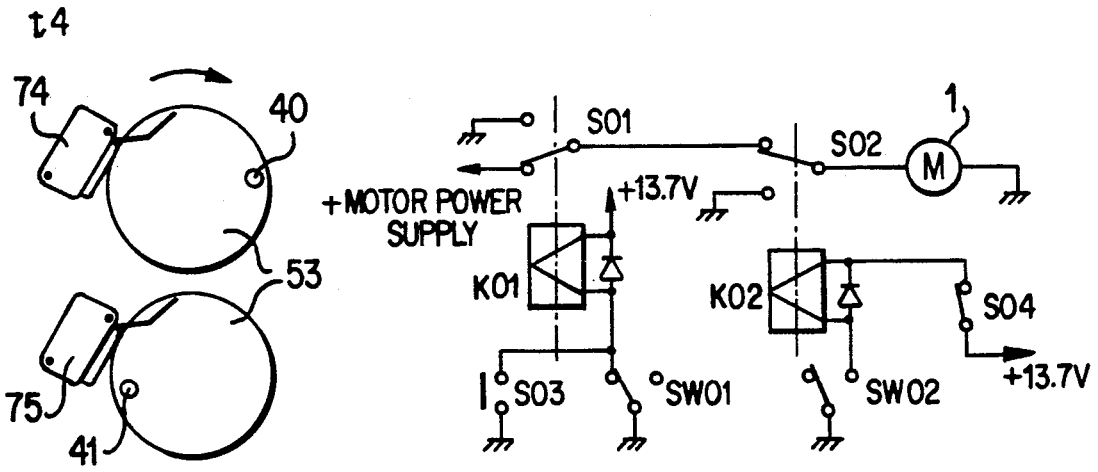

FIG. 30 shows the states of the various components of the control circuit at an instant t4 corresponding to opening the command contact S03.

Contact SW01 keeps the relay K01 actuated, and the motor 1 continues to rotate.

Figure 31:
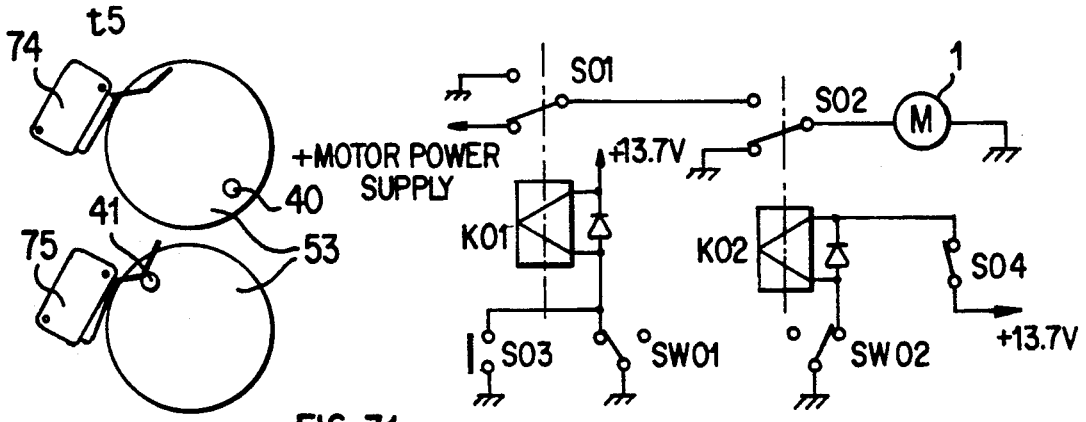

FIG. 31 shows the states of the various parts of the control circuit once the secure position has been reached at an instant t5 of the cycle shown in FIG. 34.

The stud 41 actuates the microswitch 75. The contact SW02 switches to the working position. The relay K02 is activated, thereby switching contact S02 to its working position. The motor 1 is then short circuited and stops immediately.

Figure 32:
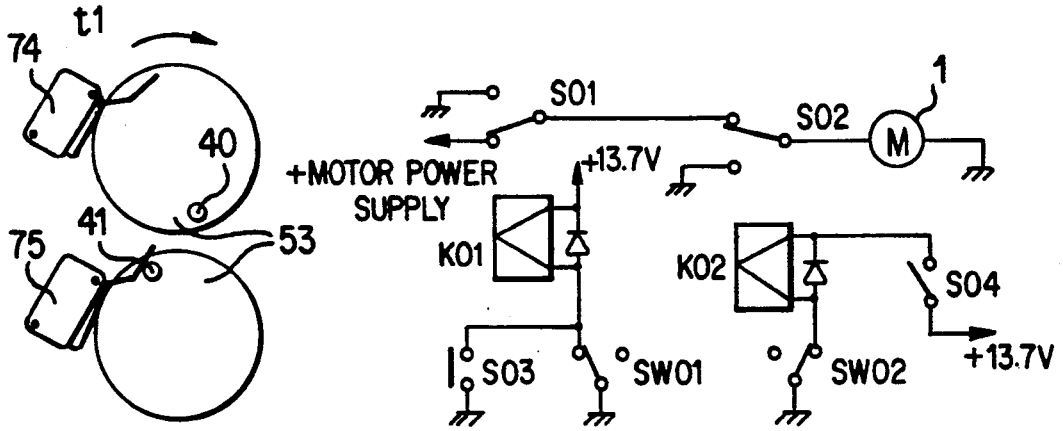
FIGS. 32 and 33 show various states of the electrical control circuit of the locking device of the invention during a cycle in which it returns to the positive safety position.
Figure 35:
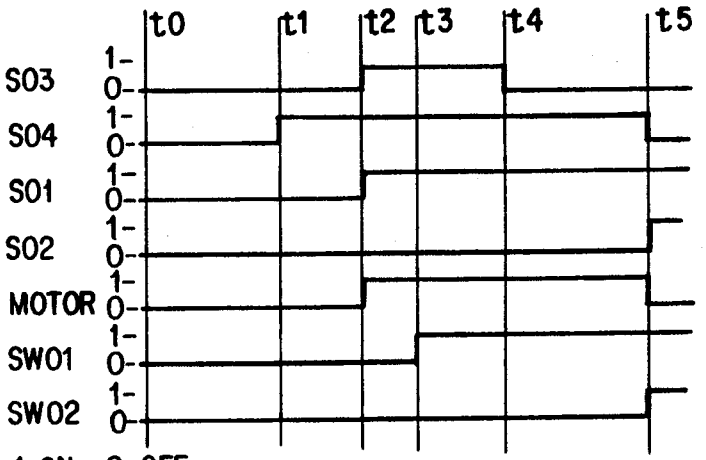
FIG. 35 is a timing diagram showing the states of the various parts of the electrical control circuit of the locking device of the invention during a cycle for putting it in a secure position.
Figure 36:
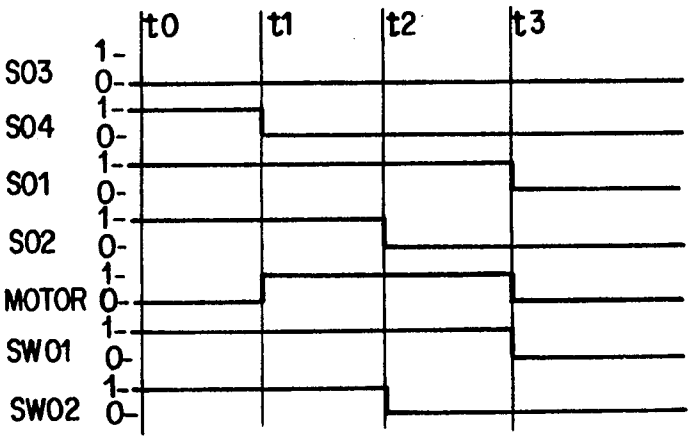
FIG. 36 is a timing diagram showing the states of the various parts of the electrical control circuit of the locking device of the invention during a cycle for returning to its positive safety position.
Figure 33:
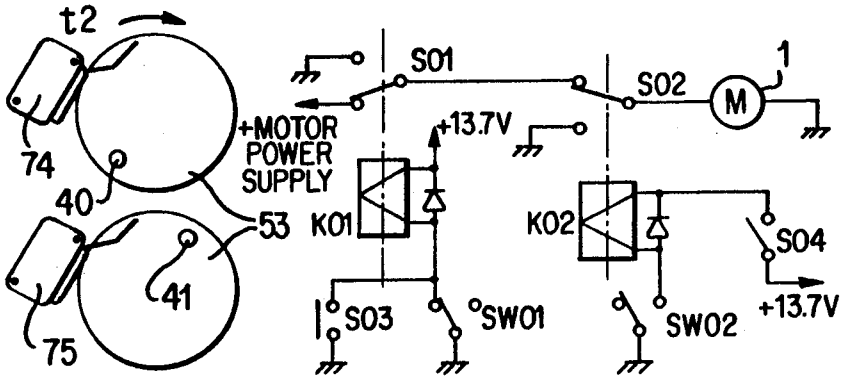

FIGS. 32, 33, and 36 relate to a cycle for returning to the positive safety locking position.

When the public come back to the premises, a command causes the bolt to pass from its secure position to its positive safety locking position.

Figure 26:
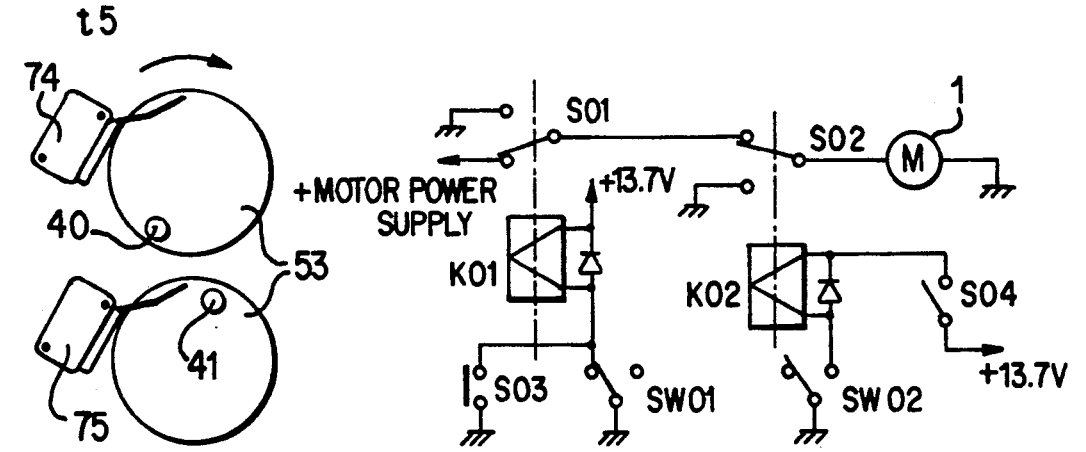

FIG. 31 shows the bolt in its secure position (instant t0 of the cycle for returning to positive safety in FIG. 26).

At instant t1 of the cycle shown in FIG. 36, a command is applied to return to the positive safety locking position, as illustrated in FIG. 32.

The contact S04 is open, thereby releasing the relay K02. The contact S02 switches to the rest position The motor 1 is powered and begins to rotate.

In an intermediate stage of the operation, at an instant t2 shown in FIG. 33, the studs 40 and 41 move under drive from the motor 1.

At the end of the cycle for returning to positive safety, at an instant t3 in the cycle of FIG. 36, the system stops in its positive safety locking position and is again the state shown in FIG. 21. The stud 40 engages the lever of the microswitch 74. The contact SW01 switches to its working position. The relay K01 releases, thereby switching the contact S01 to its rest position. The motor 1 is short-circuited and stops immediately.

We claim:

1. A locking device for an emergency exit including at least one door mounted relative to a fixed wall, the locking device being capable for locking purposes of selectively taking up a first mode of operation when the public is present and that provides positive safety, with unlocking being under remote control by an electrical current being interrupted, and a second mode of operation when the public is not present and that provides enhanced security, said locking device comprising a support plate for fixing to one of said fixed wall and said door constituting said emergency exit, a bolt for cooperating with at least one catch element defining a keeper and fixed to the other one of said door and said fixed wall constituting said emergency exit, locking means for locking said bolt, unlocking control means for unlocking said locking means, and enhanced security means for selectively inhibiting the operation of said unlocking control means, wherein the bolt has a first portion including abutment means for coming into abutment against said catch element to prevent relative movement between said door and said fixed wall, and a second portion essentially perpendicular to said first portion and mounted to pivot about a bolt axis parallel to said first and second portions, wherein the bolt cooperates both with a retraction spring which has energy stored therein in the bolt-closed position, and with a locking piston guided by a guide part along a direction perpendicular to said pivot axis to bear in a locking position against the rear face of said second portion, and wherein the locking means further includes a toggle mechanism comprising a first link pivoting about a first axis perpendicular to the displacement direction of said piston and to the bolt axis and having a position which is fixed relative to the support plate, and a second link hinged firstly to the first link and secondly to the locking piston about respective second and third moving axes parallel to said first axis, the first, second and third axes, when in the locking position, being substantially in alignment on the axis of the piston, and a toggle-collapsing spring having energy stored therein when in said locking position.

2. A locking device according to claim 1, wherein, in the locking position, the hinged assembly of the first and second links and the locking piston bears at the end of its stroke against an eccentric pivoting abutment disposed so as to enable the links to move a little past the position in which the first, second, and third axes are in accurate alignment, thereby creating a small negative angle of a few degrees between the first and second links so as to confer a position of stable equilibrium to the first and second links and to the piston.

3. A locking device according to claim 1, wherein the unlocking control means comprises an unlocking arm pivotally mounted about an axis parallel to said first, second, and third axes, said arm being provided firstly at its free end with a retention disk disposed in such a manner as to lie, in the locking position, on the active face of an electromagnet, and secondly at its hinge end with an unlocking spring and with an eccentric cam having a plane portion which, in the positive safety unlocking position, strikes the second link under the action of the unlocking spring whenever the electrical power feeding the electromagnet is interrupted.

4. A locking device according to claim 3, wherein the unlocking arm further includes a weight disposed in the vicinity of the free end of the arm in order to increase the striking force thereof.

5. A locking device according to claim 1, including an electric motor driving at least one resetting cam co-operating with a resetting mechanism and with locking mechanism control means for placing the locking device respectively in the locked position and in the enhanced security position.

6. A locking device according to claim 5, wherein the resetting mechanism includes a resetting lever and a resetting pusher cooperating with a return spring and with the unlocking arm.

7. A locking device according to claim 5, wherein the locking mechanism includes a locking lever and a locking pusher cooperating with a return spring and with the first link.

8. A locking device according to claim 5, wherein the resetting mechanism includes a resetting lever and a resetting link hinged to the unlocking arm.

9. A locking device according to claim 5, wherein the locking mechanism includes a locking lever and a locking link hinged to the first link.

10. A locking device according to claim 5, wherein the electric motor includes a worm screw coupled to its outlet shaft, said screw engaging a drive gear whose axis of rotation is common with the axis of rotation of the resetting cam and with the axis of rotation of the locking mechanism control means which are constituted by a locking cam.

11. A locking device according to claim 9, including a thrust bearing which exerts a reaction on the locking piston to compensate the lateral pressure caused by the action of the locking link on the first link.

12. A locking device according to claim 5, wherein said locking mechanism control means include a locking cam driven by said electric motor.

13. A locking device according to claim 5, wherein said locking mechanism control means include a peg fixed to the resetting mechanism and co-operating directly with a component of said locking mechanism.

14. A locking device according to claim 5, including an end-of-stroke microswitch, and a secure-position microswitch cooperating with components synchronized with the movement of the resetting mechanism and of the locking mechanism, and also a resetting microswitch and a locking microswitch for signalling the position of the unlocking arm and the position of the piston.

15. A locking device according to claim 1, wherein on each locking cycle of the device, all of its parts are initially positioned in the secure position, and then if the command for taking up the secure position is not present, the parts continue to move and come finally to rest in the positive safety locking position in which the door is locked while being unlockable by interrupting the feed current to the electromagnet under remote control.

16. A locking device according to claim 1, further including magnetic contacts actuated by permanent magnets placed in the keepers to signal the closed position of the door.

17. A locking device according to claim 1, wherein the locking device is mounted on said fixed wall and the bolt is designed to co-operate simultaneously with two wall elements defining two keepers fixed on two different halves of the door of said emergency exit.

18. A locking device according to claim 1, wherein the locking device is mounted on said fixed wall constituted by a horizontal ceiling component situated above the door and the bolt has a first portion which extends a third portion substantially perpendicular to the first portion and parallel to the second portion, but directed away therefrom, said third portion having a plane face constituting an abutment that cooperates with said wall portion defining a keeper on said door.

* * * * *